US009747742B2

(12) United States Patent
Yasaka et al.

(10) Patent No.: US 9,747,742 B2
(45) Date of Patent: Aug. 29, 2017

(54) PRODUCT DISPENSING DEVICE

(71) Applicant: FUJI ELECTRIC CO., LTD., Kawasaki-shi, Kanagawa (JP)

(72) Inventors: Yoshio Yasaka, Yokkaichi (JP); Michihiko Makino, Yokkaichi (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 0 days.

(21) Appl. No.: 15/017,060

(22) Filed: Feb. 5, 2016

(65) Prior Publication Data

US 2016/0155287 A1 Jun. 2, 2016

Related U.S. Application Data

(63) Continuation of application No. PCT/JP2014/070121, filed on Jul. 30, 2014.

(30) Foreign Application Priority Data

Nov. 14, 2013 (JP) ..... 2013-236105

(51) Int. Cl.
*G07F 11/04* (2006.01)
*G07F 11/24* (2006.01)
*G07F 9/02* (2006.01)

(52) U.S. Cl.
CPC ..... *G07F 11/24* (2013.01); *G07F 9/026* (2013.01); *G07F 11/04* (2013.01)

(58) Field of Classification Search
None
See application file for complete search history.

(56) References Cited

U.S. PATENT DOCUMENTS 5,547,105 A * 8/1996 Oden ..... G07F 11/08 221/181
5,799,823 A * 9/1998 Feltrin ..... G07F 11/08 221/242

FOREIGN PATENT DOCUMENTS

CN 1146819 A 4/1997
CN 103295326 A 9/2013
JP S61-213992 A 9/1986
(Continued)

OTHER PUBLICATIONS

PCT, "International Search Report for International Application No. PCT/JP2014/070121".
(Continued)

*Primary Examiner* — Timothy Waggoner
*Assistant Examiner* — Ayodeji Ojofeitimi
(74) *Attorney, Agent, or Firm* — Manabu Kanesaka

(57) ABSTRACT

A product dispensing device includes: one product discharging device; and the other product discharging device. The one product discharging device includes: a DC motor serving as a drive source; and a driving force applying unit configured to apply a driving force from the DC motor when a discharge command is issued. The driving force applying unit includes: an output gear configured to rotate about a central axis of the output gear according to a driving state of the DC motor; an arm member configured to rotate in accordance with a rotation direction of the output gear when the output gear is rotated; and a link lever member configured such that the one product discharging device and the other product discharging device are alternatively driven in accordance with a rotation of the arm member.

6 Claims, 22 Drawing Sheets

(56) References Cited

FOREIGN PATENT DOCUMENTS

| | | | | | |
|---|---|---|---|---|---|
| JP | H03-41380 | U | | 4/1991 | |
| JP | 2749917 | B2 | | 5/1998 | |
| JP | 2001188955 | | * | 7/2001 | ..... G07F 11/24 |
| JP | 2002-150405 | A | | 5/2002 | |

OTHER PUBLICATIONS

China Patent Office, "Office Action for Chinese Patent Application No. 201480043559.0," May 25, 2017.

* cited by examiner

PRODUCT DISPENSING DEVICE

CROSS-REFERENCE TO RELATED APPLICATION(S)

This application is a continuation of PCT international application Ser. No. PCT/JP2014/070121 filed on Jul. 30, 2014 which designates the United States, incorporated herein by reference, and which claims the benefit of priority from Japanese Patent Application No. 2013-236105, filed on Nov. 14, 2013, incorporated herein by reference.

BACKGROUND

1. Technical Field

The present disclosure relates to a product dispensing device, and more particularly, to a product dispensing device that is applied to a vending machine vending a product such as canned beverage or beverage in a plastic bottle and that appropriately discharges a product stored in a product storage passage.

2. Related Art

In the related art, in a vending machine vending a product such as canned beverage or beverage in a plastic bottle, a product storage rack is disposed in a product storage in a main cabinet which is a main body of the vending machine. The product storage rack includes a product storage passage that extends in an up-and-down direction and a product discharging device that is disposed below the product storage passage.

The product discharging device includes a lower pedal member and an upper pedal member. The lower pedal member and the upper pedal member are linked to an AC solenoid as an actuator via a link member and appropriately advances into and retreats from the product storage passage by supplying power to the AC solenoid.

In such a product discharging device, in a standby state, the upper pedal member is in a state in which the upper pedal member retreats from the product storage passage and the lower pedal member is in a state in which the lower pedal member advances into the product storage passage. Accordingly, the lower pedal member comes in contact with a lowest product stored in the product storage passage to restrain downward movement of the product stored in the product storage passage.

When a product discharge command is issued, the upper pedal member in the product discharging device in a lower part of the product storage passage storing the corresponding product advances into the product storage passage via the link member by supplying power to the AC solenoid and comes in contact with a second lowest product to restrain downward movement of the second lowest product and a product stored above the second lowest product. By supplying power to the AC solenoid, the lower pedal member retreats from the product storage passage and discharges only the lowest product downward, and the lower pedal member advances into the product storage passage by a bias force of a spring when the lowest product passes through the lower pedal member. Thereafter, when the power-supplied state of the AC solenoid is released and power is not supplied thereto, retreat movement of the lower pedal member advanced into the product storage passage is restrained and the upper pedal member is in the state in which the upper pedal member retreats from the product storage passage, whereby the above-mentioned standby state is returned.

In the product storage rack, two product storage passages are generally adjacent to each other in the front-rear direction and thus the product discharging devices respectively applied to the product storage passages are coupled to each other back to back and are disposed in the product storage passages. In the product discharging devices, the AC solenoid as a drive source is required for each of the coupled product discharging devices.

Accordingly, a product dispensing device has been proposed in which product discharging devices from which an AC solenoid has been removed are disposed back to back, a drive source and a cam member are disposed therebetween, and the product discharging devices are driven by driving of the drive source and rotation of the cam member so as to achieve a decrease in manufacturing cost by reducing the number of drive sources (for example, see JP 2749917 B2).

SUMMARY

In some embodiments, a product dispensing device includes: one product discharging device that is applied to one product storage passage extending in an up-and-down direction and storing an input product in an extending direction of the one product storage passage, the one product discharging device being configured to restrain the product stored in the one product storage passage from moving downward in a standby state, and to discharge a lowest product stored in the one product storage passage downward in a driven state; and the other product discharging device that is applied to the other product storage passage extending in the up-and-down direction so as to be adjacent to the one product storage passage and storing an input product in an extending direction of the other product storage passage, the other product discharging device being configured to restrain the product stored in the other product storage passage from moving downward in a standby state, and to discharge a lowest product stored in the other product storage passage downward in a driven state. The one product discharging device and the other product discharging device being coupled to each other back to back. The one product discharging device includes: a DC motor serving as a drive source; and a driving force applying unit configured to apply a driving force from the DC motor when a discharge command is issued. The driving force applying unit includes: an output gear configured to rotate about a central axis of the output gear in one direction or in the other direction according to a driving state of the DC motor; an arm member configured to rotate in accordance with a rotation direction of the output gear when the output gear is rotated; and a link lever member configured such that the one product discharging device and the other product discharging device are alternatively driven in accordance with a rotation of the arm member.

The above and other features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 18-1 is a diagram illustrating an operation state when a motor is driven to rotate positively in FIG. 17 when viewed from the rear side;

FIG. 18-2 is a diagram illustrating an operation state when the motor is driven to rotate positively in FIG. 17 when viewed from the rear side;

FIG. 18-3 is a diagram illustrating an operation state when the motor is driven to rotate positively in FIG. 17 when viewed from the rear side;

FIG. 19-1 is a diagram illustrating an operation state of an output gear when the motor is driven to rotate positively in FIG. 17 when viewed from the rear side;

FIG. 19-2 is a diagram illustrating an operation state of the output gear when the motor is driven to rotate positively in FIG. 17 when viewed from the rear side;

FIG. 19-3 is a diagram illustrating an operation state of the output gear when the motor is driven to rotate positively in FIG. 17 when viewed from the rear side;

FIG. 20-1 is a diagram illustrating an operation state when the motor is driven to rotate reversely in FIG. 17 when viewed from the rear side;

FIG. 20-2 is a diagram illustrating an operation state when the motor is driven to rotate reversely in FIG. 17 when viewed from the rear side;

FIG. 20-3 is a diagram illustrating an operation state when the motor is driven to rotate reversely in FIG. 17 when viewed from the rear side;

FIG. 21-1 is a diagram illustrating an operation state of an output gear when the motor is driven to rotate reversely in FIG. 17 when viewed from the rear side;

FIG. 21-2 is a diagram illustrating an operation state of the output gear when the motor is driven to rotate reversely in FIG. 17 when viewed from the rear side;

FIG. 21-3 is a diagram illustrating an operation state of the output gear when the motor is driven to rotate reversely in FIG. 17 when viewed from the rear side.

DETAILED DESCRIPTION

Hereinafter, a product dispensing device according to an exemplary embodiment of the present invention will be described in detail with reference to the accompanying drawings.

Figure 1:
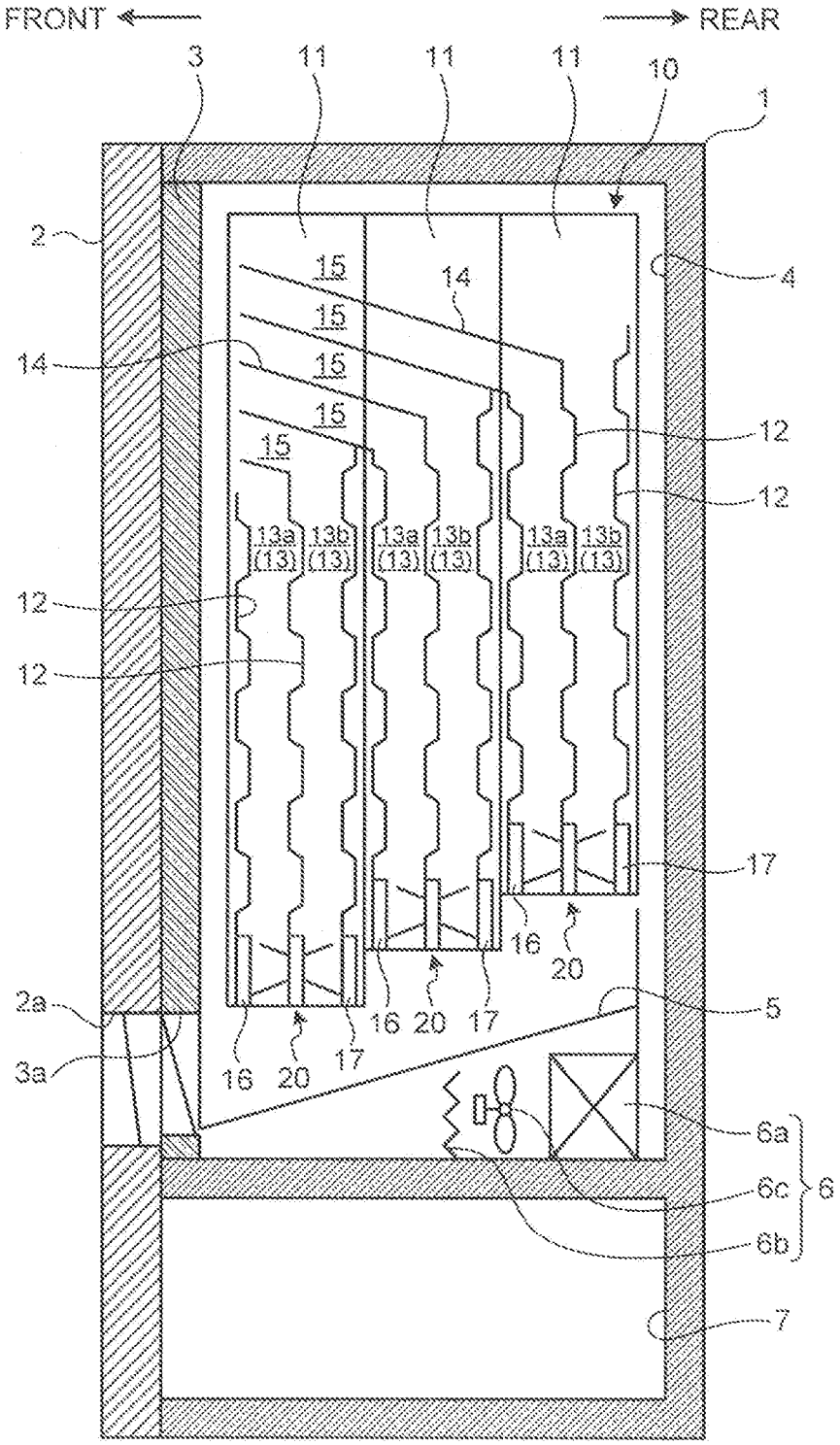
FIG. 1 is a cross-sectional side view illustrating an internal structure of a vending machine to which a product dispensing device according to an embodiment of the present invention is applied when viewed from the right side.

FIG. 1 is a cross-sectional side view illustrating an internal structure of a vending machine to which a product dispensing device according to an embodiment of the present invention is applied when viewed from the right side. The vending machine exemplified herein vends a product in a cooled or heated state and includes a main cabinet 1, an outer door 2, and an inner door 3.

The main cabinet 1 has a rectangular parallelepiped shape of which a front surface is opened by appropriately combining plural steel sheets and includes a product storage 4 having a heat-insulating structure therein. The outer door 2 serves to cover the front opening of the main cabinet 1 and is disposed at one edge portion of the main cabinet 1 so as to be opened and closed. The front surface of the outer door 2 is provided with elements required for vending the product such as a display window, a product selection button, a bill input port, a coin input port, a return lever, a built-in display, a coin return port, and a product output port 2*a*. The inner door 3 is a heat-insulating door which is divided into upper and lower parts to cover the front opening of the product storage 4, the upper heat-insulating door is disposed at one edge portion of the outer door 2 at a position inside the outer door 2 so as to be opened and closed, and the lower heat-insulating door is disposed at one edge portion of the main cabinet 1 so as to be opened and closed. A product discharge port 3*a* for discharging a product to the outside of the product storage 4 is disposed in a lower part of the lower heat-insulating door of the inner door 3.

In the vending machine, a product chute 5 is disposed in the product storage 4, a temperature control unit 6 is disposed in an area (hereinafter, also referred to as a "heat exchange area") below the product chute 5, and a product storage rack 10 is disposed in an area (hereinafter, also referred to as a "product storage area") above the product chute 5.

The product chute 5 is a plate-like member that guides a product discharged from the product storage rack 10 to the product discharge port 3*a* of the inner door 3 and is disposed to be gradually inclined downward toward the front side. Although not clearly illustrated in the drawing, plural vent holes (not illustrated) causing the heat exchange area and the product storage area to communicate with each other are formed in the product chute 5.

The temperature control unit 6 serves to maintain the internal atmosphere of the product storage 4 in a desired temperature state and includes an evaporator 6*a*, an electric heater 6*b*, and a blower fan 6*c* of a refrigeration cycle. In the temperature control unit 6, for example, when the blower fan 6*c* is driven in a state in which the refrigeration cycle operates, air cooled in the evaporator 6*a* is supplied upward through the vent holes of the product chute 5 and thus the product storage area can be maintained in a low-temperature state. On the other hand, when the blower fan 6*c* is driven in a state in which power is supplied to the electric heater 6*b*, air heated by the electric heater 6*b* is supplied upward through the vent holes of the product chute 5 and the product storage area can be maintained in a high-temperature state. Although not clearly illustrated in the drawing, a compressor, a condenser, and an expansion valve of the refrigeration cycle are all disposed in a machine room 7 outside the product storage 4.

The product storage racks 10 are arranged in three lines in the front-rear direction, include plural (two in the illustrated example) product storage passages 13 which are formed in a meandering shape in the up-and-down direction by disposing passage elements 12 between a pair of base side plates 11, and store plural products with a sideways posture in the up-and-down direction in the product storage passages 13. More specifically, the passage elements 12 are appropriately disposed on the front side and the rear side of the product storage passages 13 so as to face each other and are fixed to the base side plate 11. Accordingly, in each product storage rack 10, two product storage passages 13 are disposed to be adjacent to each other in the front-rear direction. In the following description, the front product storage passage 13 in one product storage rack 10 is also referred to as a first product storage passage 13*a* and the rear product storage passage 13 is also referred to as a second product storage passage 13*b*.

Although not clearly illustrated in the drawing, the passage elements 12 are provided with flappers. The flappers are swingably disposed in the passage elements 12 so as to advance into and retreat from the product storage passage 13. The flappers are biased by coil springs (not illustrated) and advance into the product storage passages 13 in a normal state. The flapper retreats along the meandering product storage passage 13 against a bias force of the coil spring to correct the posture of a product by coming in contact with the product passing through the product storage passage 13.

In the product storage rack 10, a top tray 14 is disposed in the top of the product storage passage 13 and a product dispensing device 20 is disposed in the bottom of the product storage passage 13.

The top tray 14 is formed by bending a plate-like metal sheet, and the top tray is disposed between the base side plates 11 so as to be gradually inclined downward from the front side to the rear side. The top surface of the top tray 14 constitutes a product guide passage 15 that guides a product input through an input port to the product storage passage 13.

Figure 2:
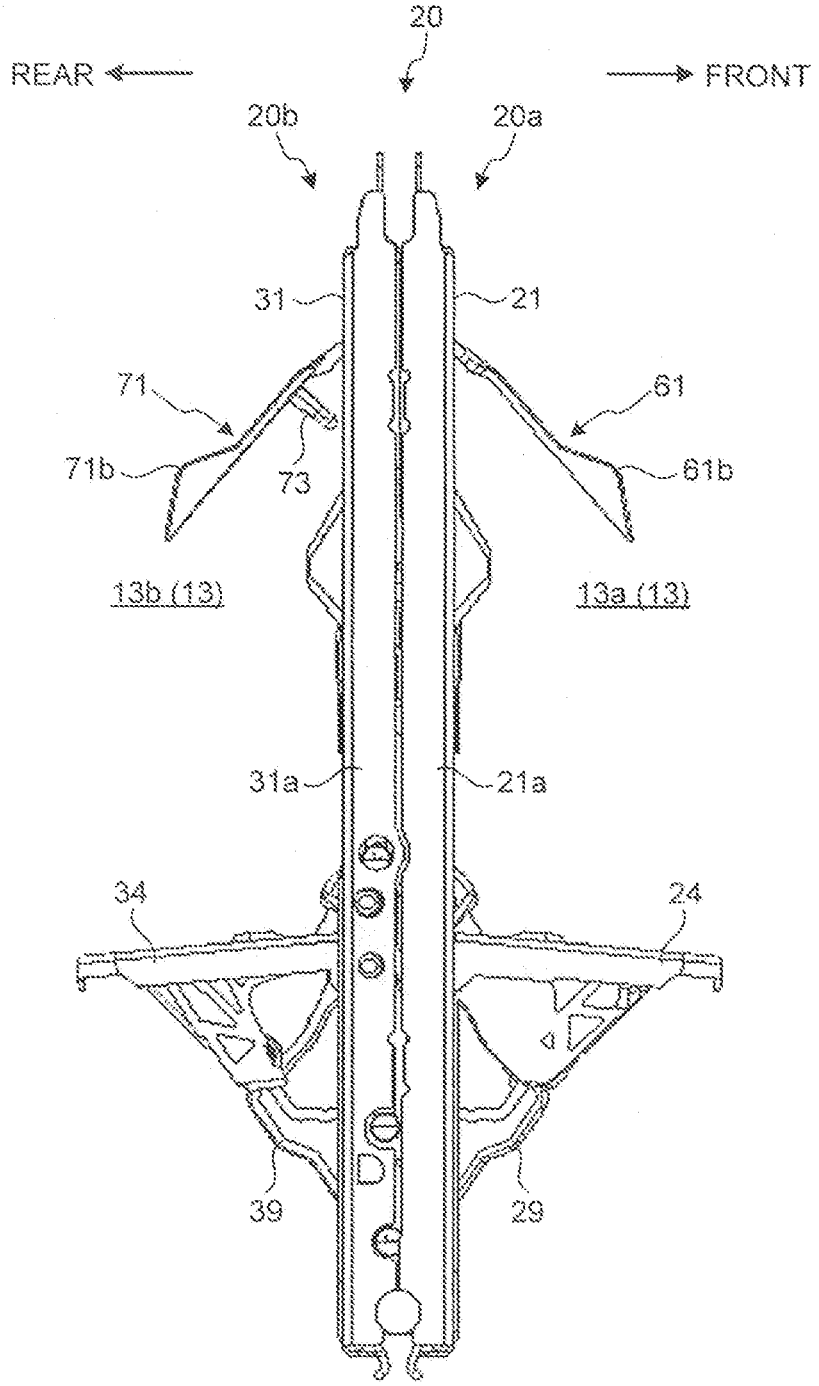
FIG. 2 is a side view illustrating the product dispensing device illustrated in FIG. 1 when viewed from the left side.
Figure 3:
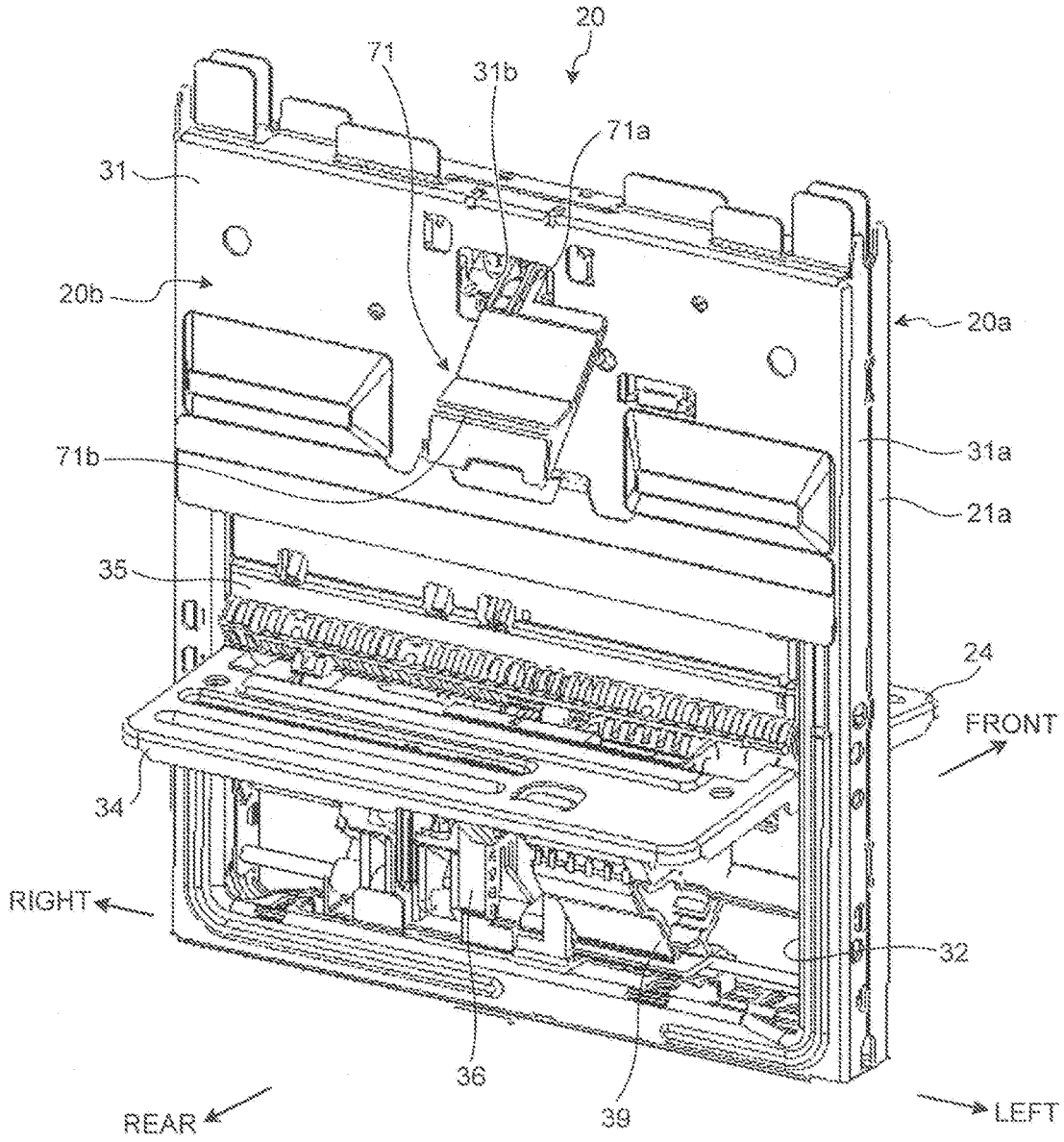
FIG. 3 is a perspective view illustrating the product dispensing device illustrated in FIG. 1 when viewed from the rear-left side.
Figure 4:
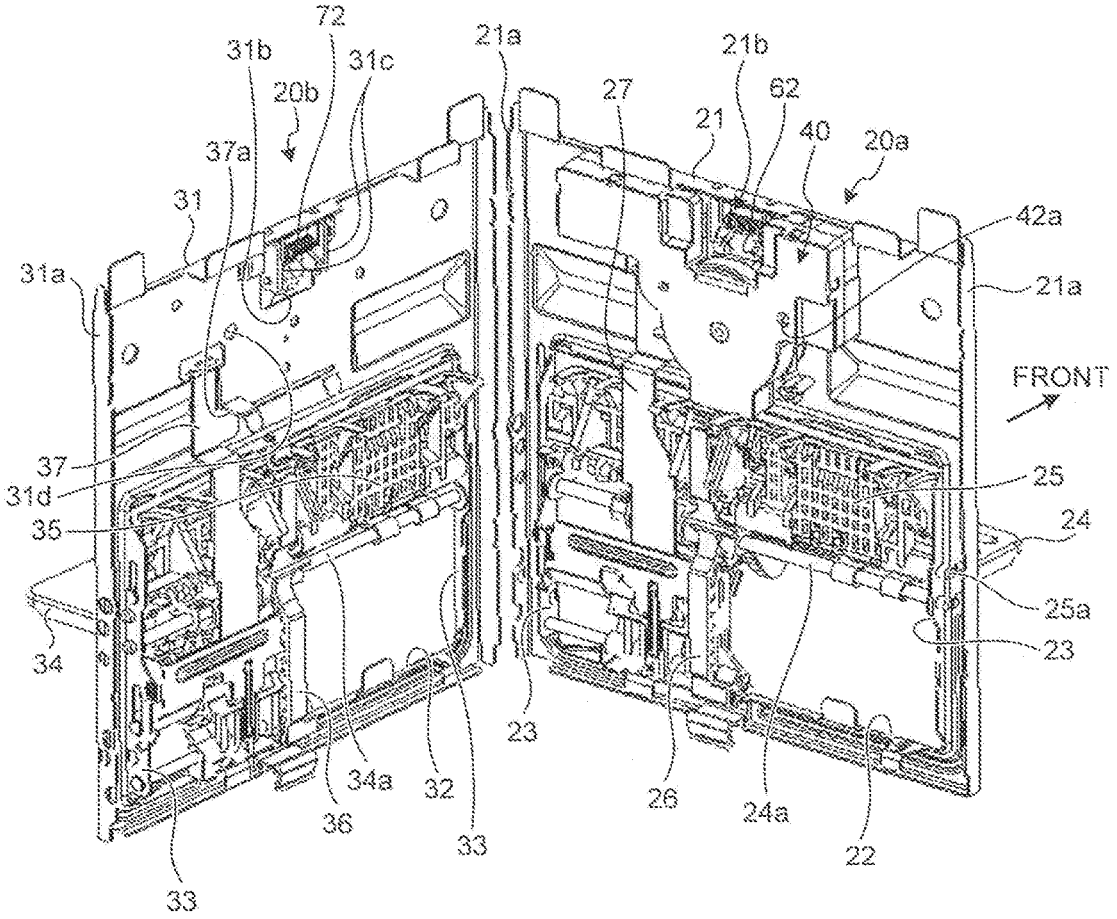
FIG. 4 is a diagram illustrating a state in which elements of the product dispensing device illustrated in FIG. 1 are disassembled.

FIGS. 2 to 4 illustrate the product dispensing device 20 illustrated in FIG. 1, where FIG. 2 is a side view thereof when viewed from the left side, FIG. 3 is a perspective view thereof when viewed from the rear-left side, and FIG. 4 is a diagram in which elements of the product dispensing device 20 are disassembled.

As illustrated in FIGS. 2 to 4, the product dispensing device 20 includes one product discharging device (hereinafter, also referred to as a first discharge mechanism) 20*a* and the other product discharging device (hereinafter, also referred to as a second discharge mechanism) 20*b*, where the first discharge mechanism 20*a* and the second discharge mechanism 20*b* are coupled to each other back to back.

Figure 5:
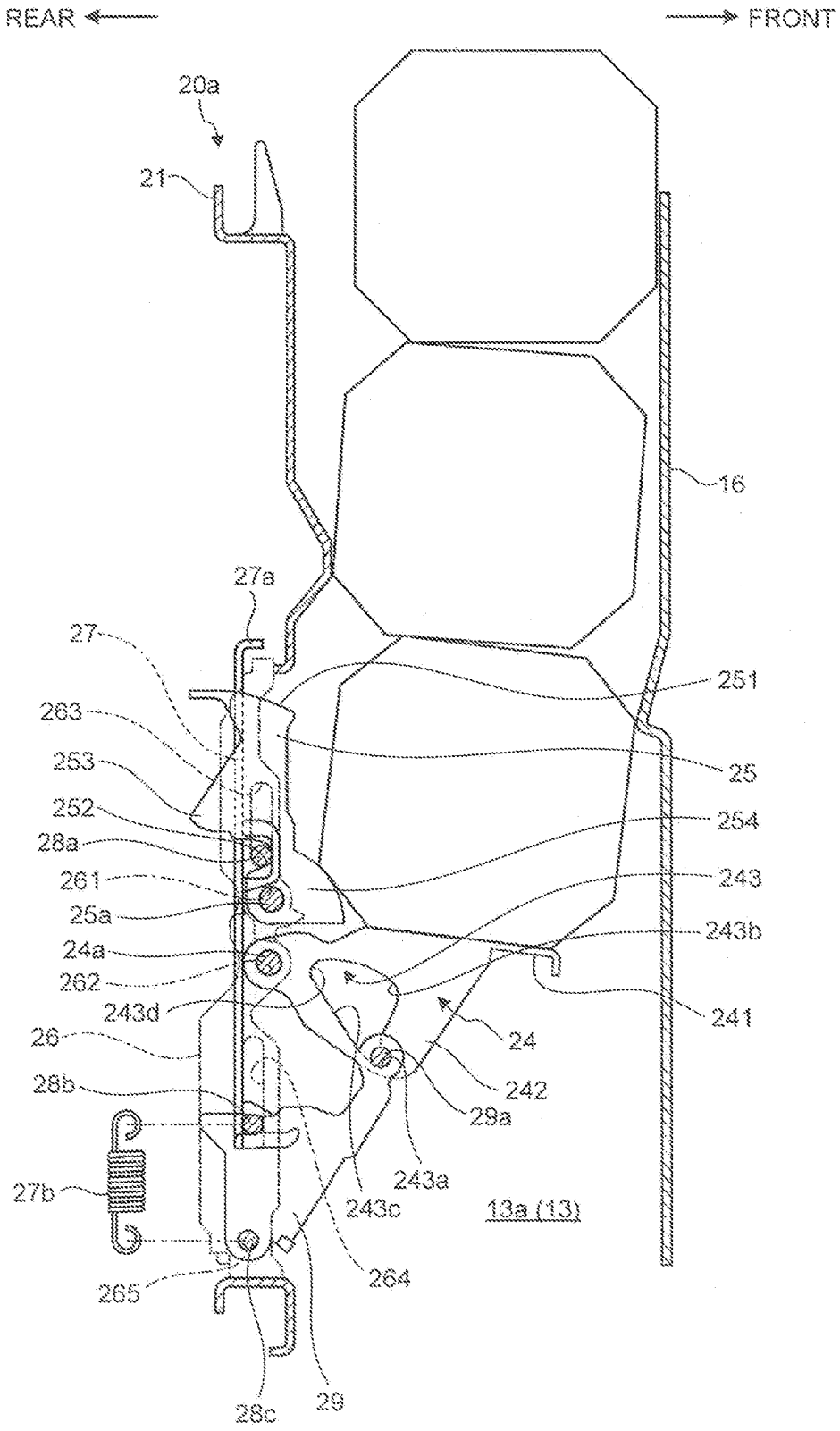
FIG. 5 is a diagram schematically illustrating principal parts of a first discharge mechanism (one product discharging device) illustrated in FIGS. 2 to 4 when viewed from the left side.
Figure 6:
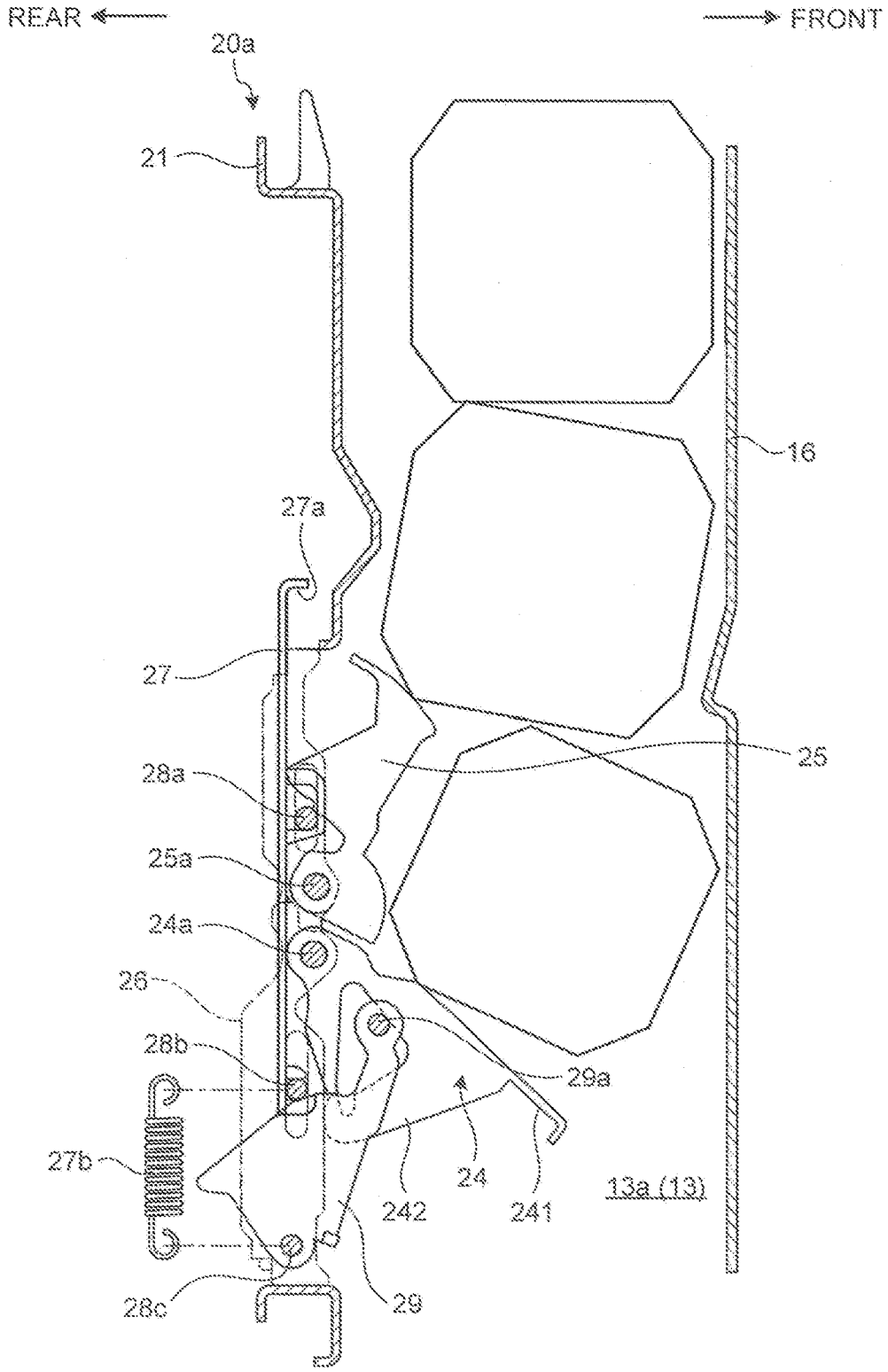
FIG. 6 is a diagram schematically illustrating principal parts of the first discharge mechanism illustrated in FIGS. 2 to 4 when viewed from the left side.
Figure 7:
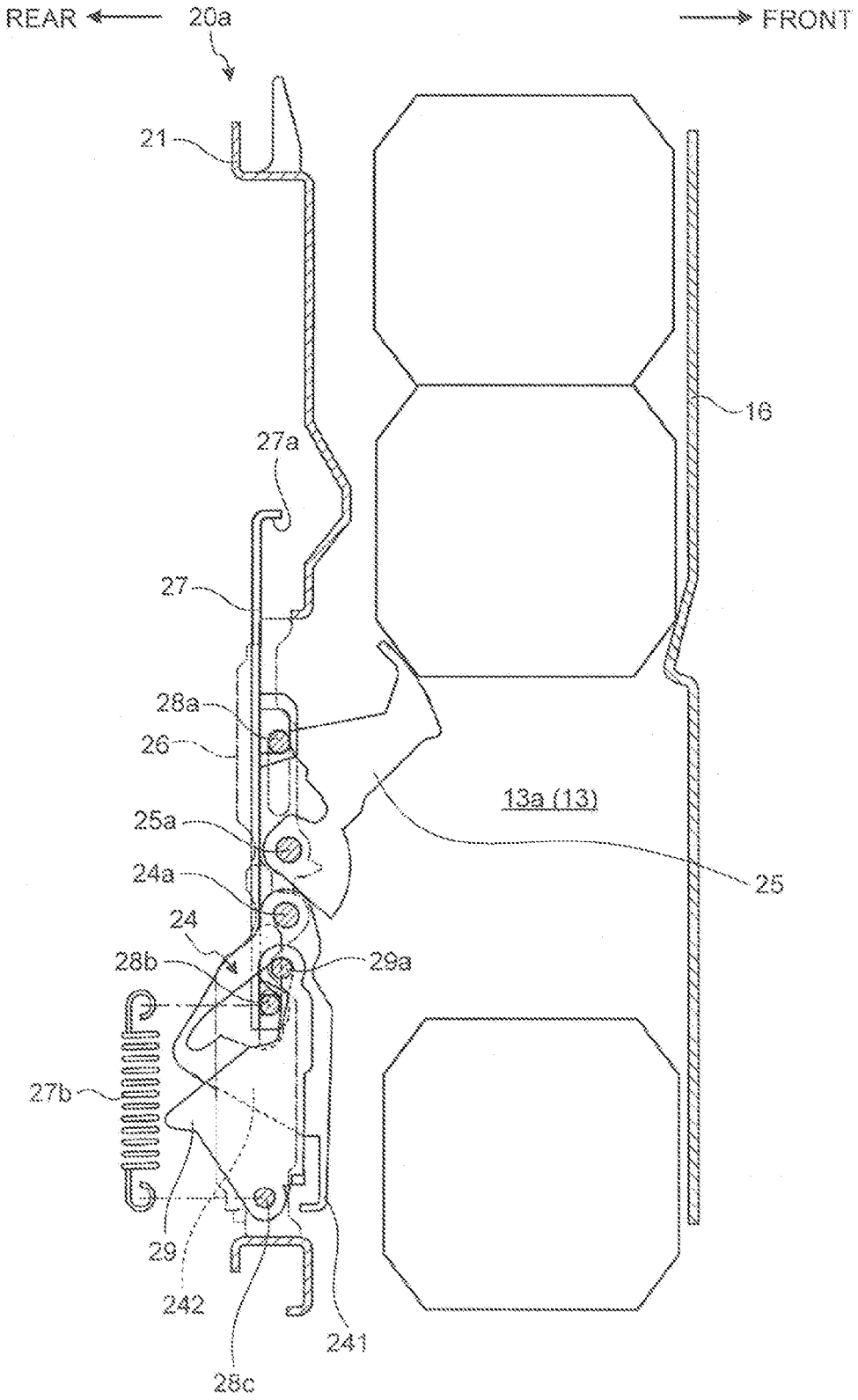
FIG. 7 is a diagram schematically illustrating principal parts of the first discharge mechanism illustrated in FIGS. 2 to 4 when viewed from the left side.

FIGS. 5 to 7 are diagrams schematically illustrating principal parts of the first discharge mechanism 20*a* illustrated in FIGS. 2 to 4 when viewed from the left side. In the following description, the structure of the first discharge mechanism 20*a* will be described appropriately with reference to FIGS. 5 to 7.

The first discharge mechanism 20*a* is applied to the first product storage passage 13*a* and is disposed in the bottom of the first product storage passage 13*a*. The first discharge mechanism 20*a* serves to store products in the first product storage passage 13*a* in a standby state and to discharge a product to the product chute 5 in a driven state by controlling behavior of product between opposite passage width defining plates 16, and includes a base member 21.

The base member 21 is formed by performing a cutting process and a bending process on a steel sheet and is disposed to cause its own surface to face the passage width defining plate 16, and an insertion hole 22 is formed in an intermediate portion thereof. The insertion hole 22 is a rectangular through-opening. A side wall 21*a* is formed on both sides of the base member 21 by bending both sides thereof.

A pair of right and left bearing pieces 23 disposed on both sides of the insertion hole 22 of the base member 21 is provided with a first swing support shaft 24*a* and a second swing support shaft 25*a*.

The first swing support shaft 24*a* is an axial member which is disposed to extend substantially in the horizontal direction and supports a lower pedal member 24 in the middle way. The second swing support shaft 25*a* is an axial member which is disposed above the first swing support shaft 24*a* so as to extend substantially in the horizontal direction and supports an upper pedal member 25 in the middle way.

The lower pedal member 24 is a plate-like member and is disposed to be swingable about the axis of the first swing support shaft 24*a* by inserting the first swing support shaft 24*a* into the base end thereof.

The tip of the lower pedal member 24 extends in an outer radial direction of the first swing support shaft 24*a*, and can advance into and retreat from the first product storage passage 13*a* via the insertion hole 22 when the lower pedal member swings about the axis of the first swing support shaft 24*a*. That is, the lower pedal member 24 is swingably disposed to advance into and retreat from the first product storage passage 13*a*.

A lower pedal member spring (not illustrated) is interposed between the lower pedal member 24 and the base member 21. The lower pedal member spring normally biases the lower pedal member 24 in the advancing direction to the first product storage passage 13*a*.

The lower pedal member 24 includes a plate-like pedal body 241 and a pair of guide portions 242. The pair of guide portions 242 is disposed on the rear side of the pedal body 241. Each guide portion 242 is a plate-like member extending in the up-and-down direction and both are formed to face each other. A guide groove 243 is formed on the facing surfaces of the guide portions 242.

The guide groove 243 includes a fitting portion 243*a* which is located at the lowest position in a state in which the lower pedal member 24 is disposed at a forward-moved position at which the lower pedal member most advances into the first product storage passage 13*a* (the state illustrated in FIG. 5) and into which a pedal operating shaft 29*a* of a rotation stopper member 29 to be described later is fitted, a contact portion 243*d* which is located at the highest position in a state in which the lower pedal member 24 is disposed at a backward-moved position at which the lower pedal member most retreats from the first product storage passage 13*a* (the state illustrated in FIG. 7) and with which the pedal operating shaft 29*a* of the rotation stopper member 29 comes in contact, and a first guide portion 243*b* and a second guide portion 243*c* which are continuously connected to the fitting portion 243*a* and the contact portion 243*d*.

The first guide portion 243*b* is formed in the guide portion 242 so as to be inclined obliquely upward from the fitting portion 243*a* so as to get away from the base member 21, be inclined obliquely upward so as to get close to the base member 21, and then reach the contact portion 243*d* in a state in which the lower pedal member 24 is located at the position (forward-moved position) at which the lower pedal member most advances into the first product storage passage 13*a*.

The second guide portion 243*c* is formed in the guide portion 242 so as to be inclined obliquely downward from the contact portion 243*d* so as to get away from the base member 21 and then reach the fitting portion 243*a* in a state in which the lower pedal member 24 is located at the position (forward-moved position) at which the lower pedal member most advances into the first product storage passage 13*a*.

The length in the outer radial direction of the lower pedal member 24 from the first swing support shaft 24*a* is set to a length with which a gap smaller than the maximum width of a product having a small maximum width can be secured between the passage width defining plate 16 and the lower pedal member as illustrated in FIG. 5 when the lower pedal member is located at the position (forward-moved position) at which the lower pedal member most advances into the first product storage passage 13*a*.

The upper pedal member 25 is a plate-like member and is disposed in the base member 21 so as to be swingable about the axis of the second swing support shaft 25*a* by inserting the second swing support shaft 25*a* into the base end thereof.

The tip of the upper pedal member 25 extends in an outer radial direction of the second swing support shaft 25*a*, and can advance into and retreat from the first product storage passage 13*a* via the insertion hole 22 when the upper pedal member swings about the axis of the second swing support shaft 25*a*. That is, the upper pedal member 25 is swingably disposed to advance into and retreat from the first product storage passage 13*a*.

An upper pedal member spring (not illustrated) is interposed between the upper pedal member 25 and the base member 21. The upper pedal member spring normally biases the upper pedal member 25 in the retreating direction to the first product storage passage 13*a*.

The upper pedal member 25 is provided with a pressing inclined surface 251, a concave portion 252, a stopper contact portion 253, and a protrusion 254. The pressing inclined surface 251 is disposed in the tip portion of the upper pedal member 25 and is a curved inclined surface which is formed to be gradually lowered toward the first product storage passage 13*a* when the upper pedal member 25 retreats from the first product storage passage 13*a*. The concave portion 252 is disposed on the rear side of the upper pedal member 25 and is a set of concave places extending substantially in the horizontal direction and being formed to be opened to both side surfaces of the upper pedal member 25. The stopper contact portion 253 is a portion with which a stopper pin 28*a* to be described later comes in contact and is disposed to be inclined to the upper side of the concave portion 252 on the rear surface of the upper pedal member 25.

The protrusion 254 is disposed in the base portion of the upper pedal member 25 so as to protrude toward the first product storage passage 13*a*.

The upper pedal member 25 is biased to retreat from the first product storage passage 13*a* by a biasing force of the upper pedal member spring and the initial position thereof is set in a state in which the upper pedal member retreats from the first product storage passage 13*a* by bringing the stopper pin 28*a* into contact with the concave portion 252.

The upper pedal member 25 is inclined to the front side with respect to the vertical plane passing through the second swing support shaft 25*a* in a state in which the upper pedal member is located at the position (forward-moved position) at which the upper pedal member most advances into the first product storage passage 13*a* (the state illustrated in FIG. 7). The length in the outer radial direction of the upper pedal member 25 from the second swing support shaft 25*a* is set to a length with which a gap smaller than the maximum width of a product having a small maximum width can be secured between the passage width defining plate 16 and the upper pedal member in the state in which the upper pedal member is inclined to the front side.

The base member 21 is provided with a bearing portion 26. The bearing portion 26 serves to guide movement of a pedal link member 27 in the up-and-down direction, is formed to extend in the up-and-down direction, and is disposed to vertically cross the insertion hole 22 such that one end thereof is attached to an upper edge of the insertion hole 22 and the other end is attached to a lower edge of the insertion hole 22.

The bearing portion 26 is formed of a resin material and includes a second swing support shaft insertion hole 261, a first swing support shaft insertion hole 262, a stopper pin insertion hole 263, a pedal stopper pin support groove 264, and a stopper support hole 265.

The second swing support shaft insertion hole 261 is a hole through which the second swing support shaft 25*a* is inserted and which axially supports the second swing support shaft 25*a*. The first swing support shaft insertion hole 262 is a hole through which the first swing support shaft 24*a* is inserted and which axially supports the first swing support shaft 24*a*. The first swing support shaft insertion hole 262 is formed below the second swing support shaft insertion hole 261.

The stopper pin insertion hole 263 is a hole which axially slidably supports a stopper pin 28*a* to be described later and is formed such that an extending length thereof in the up-and-down direction is larger than the diameter of the stopper pin 28*a* formed in an axial shape. Accordingly, the stopper pin insertion hole 263 allows movement of the stopper pin 28*a* in the up-and-down direction and is disposed in a substantially middle portion between the upper end of the bearing portion 26 and the portion in which the second swing support shaft insertion hole 261 is formed.

The pedal stopper pin support groove 264 is a hole which axially slidably supports a pedal stopper pin 28*b* to be described later and is formed such that an extending length thereof in the up-and-down direction is larger than the diameter of the pedal stopper pin 28*b* formed in an axial shape. Accordingly, the pedal stopper pin support groove 264 allows movement of the pedal stopper pin 28*b* in the up-and-down direction and is disposed in a substantially middle portion between the portion in which the first swing support shaft insertion hole 262 is formed and the lower end of the bearing portion 26.

The stopper support hole 265 is a hole that axially supports a stopper shaft 28*c* to be described later and is formed at the lower end of the bearing portion 26.

The stopper pin 28*a*, the pedal stopper pin 28*b*, and the stopper shaft 28*c* are disposed between one bearing piece 23 and the bearing portion 26.

The stopper pin 28*a* is an axial member that is disposed substantially in the horizontal direction between one bearing piece 23 and the bearing portion 26, one end of which is inserted into a stopper pin insertion hole (not illustrated) of the bearing piece 23 and the other end of which is inserted into the stopper pin insertion hole 263 of the bearing portion 26. The stopper pin 28*a* is coupled to a pedal link member 27 and is movable in the up-and-down direction in the stopper pin insertion hole 263 with the movement in the up-and-down direction of the pedal link member 27. The stopper pin 28*a* comes in contact with the concave portion 252 of the upper pedal member 25 located at the initial position.

The pedal stopper pin 28*b* is an axial member that is disposed substantially in the horizontal direction between one bearing piece 23 and the bearing portion 26, one end of which is inserted into a pedal stopper pin support groove (not illustrated) of the bearing piece 23 and the other end of which is inserted into the pedal stopper pin support groove 264 of the bearing portion 26. The pedal stopper pin 28*b* is coupled to the pedal link member 27 and is movable in the up-and-down direction in the pedal stopper pin support groove 264 with the movement in the up-and-down direction of the pedal link member 27. The circumferential surface of the pedal stopper pin 28*b* comes in contact with the inner circumferential surface of the pedal stopper pin support groove 264 when the pedal link member 27 moves in the up-and-down direction.

The stopper shaft 28*c* is an axial member that is disposed substantially in the horizontal direction between one bearing piece 23 and the bearing portion 26 and supports the rotation stopper member 29 in the middle way thereof.

The rotation stopper member 29 is disposed between one bearing piece 23 and the bearing portion 26 so as to insert the stopper shaft 28*c* into the base end portion thereof and to be swingable about an axis of the stopper shaft 28*c*.

The tip portion of the rotation stopper member 29 extends in the outer radial direction of the stopper shaft 28*c* and can advance into and retreat from the first product storage passage 13*a* via the insertion hole 22 when the rotation stopper member 29 swings about the axis of the stopper shaft 28*c*.

The rotation stopper member 29 includes a pedal operating shaft 29*a* at the tip portion thereof. The pedal operating shaft 29*a* is an axial member that is disposed substantially in the horizontal direction and both ends thereof are fitted into the guide grooves 243 of the lower pedal member 24.

A pedal operating member spring (not illustrated) is interposed between the rotation stopper member 29 and the base member 21. The pedal operating member spring normally biases the rotation stopper member 29 in the advancing direction to the first product storage passage 13*a*.

The rotation stopper member 29 is biased in the advancing direction to the first product storage passage 13*a* by the pedal operating member spring, movement in the retreating direction of the rotation stopper member 29 is restrained by bringing the pedal stopper pin 28*b* into contact with a predetermined part on the rear side thereof, and the initial position thereof in the state in which the rotation stopper member advances into the first product storage passage 13*a* is set. Since the lower pedal member 24 is biased by the lower pedal member spring, the initial position of the rotation stopper member 29 is set to a position at which both ends of the pedal operating shaft 29*a* are located in the fitting portion 243*a* of the guide grooves 243 and the lower pedal member 24 advances into the first product storage passage 13*a*.

The pedal link member 27 is a long plate-like member that extends in the up-and-down direction and includes a claw 27*a* which is formed by bending a part of the upper portion to the front side. Although details thereof will be described later, the pedal link member 27 is movable in the up-and-down direction.

A link spring 27*b* is interposed between the pedal link member 27 and the base member 21. The link spring 27*b* normally biases the pedal link member 27 downward. Although not clearly illustrated in the drawings, a second link spring is interposed between the pedal link member 27 and the base member 21. One end of the second link spring is locked to an engagement hole formed at the lower end of the pedal link member 27 and the other end thereof is locked to the stopper shaft 28*c*. The second link spring normally prevents the engagement of the pedal link member 27 and the pedal stopper pin 28*b* from being released by its own elastic force.

In a state in which the pedal link member 27 is biased by the link spring 27*b* and is located on the lower side, the stopper pin 28*a* is disposed at the lower end of the stopper pin insertion hole 263 and the pedal stopper pin 28*b* is disposed at the lower end of the pedal stopper pin support groove 264. In this state, the concave portion 252 of the upper pedal member 25 disposed at the backward-moved position comes in contact with the stopper pin 28*a*. The rotation stopper member 29 disposed at the forward-moved position comes in contact with the pedal stopper pin 28*b* to restrain the retreat movement of the rotation stopper member 29. The pedal operating shaft 29*a* of the rotation stopper member 29 disposed at the forward-moved position is fitted into the fitting portion 243*a* of the lower pedal member 24 to restrain the retreat movement of the lower pedal member 24 disposed at the forward-moved position.

On the other hand, in the state in which the pedal link member 27 is located on the upper side against the biasing force of the link spring 27*b*, as illustrated in FIG. 7, the stopper pin 28*a* is disposed at the upper end of the stopper pin insertion hole 263 and the pedal stopper pin 28*b* is disposed at the upper end of the pedal stopper pin support groove 264. In this state, the stopper contact portion 253 of the upper pedal member 25 comes in contact with the stopper pin 28*a* to restrain the retreat movement of the upper pedal member 25, and the upper pedal member 25 advances against the biasing force of the upper pedal member spring and is disposed at the forward-moved position.

On the other hand, since the restraining of the retreat movement due to the pedal stopper pin 28*b* is released, the restraining of the retreat movement of the rotation stopper member 29 with respect to the stopper shaft 28*c* is released. Here, the weight of a product coming in contact with the lower pedal member 24 maintained at the forward-moved position by the rotation stopper member 29 is applied to the rotation stopper member 29, and the rotation stopper member 29 starts its retreat movement with releasing the restraining of the retreat movement of the rotation stopper member 29. When the retreat movement of the rotation stopper member 29 is started, the pedal operating shaft 29*a* departs from the fitting portion 243*a* of the lower pedal member 24. Accordingly, the lower pedal member 24 is allowed to retreat about the first swing support shaft 24*a* and retreats against the elastic biasing force of the lower pedal member spring by the weight of the product.

Figure 8:
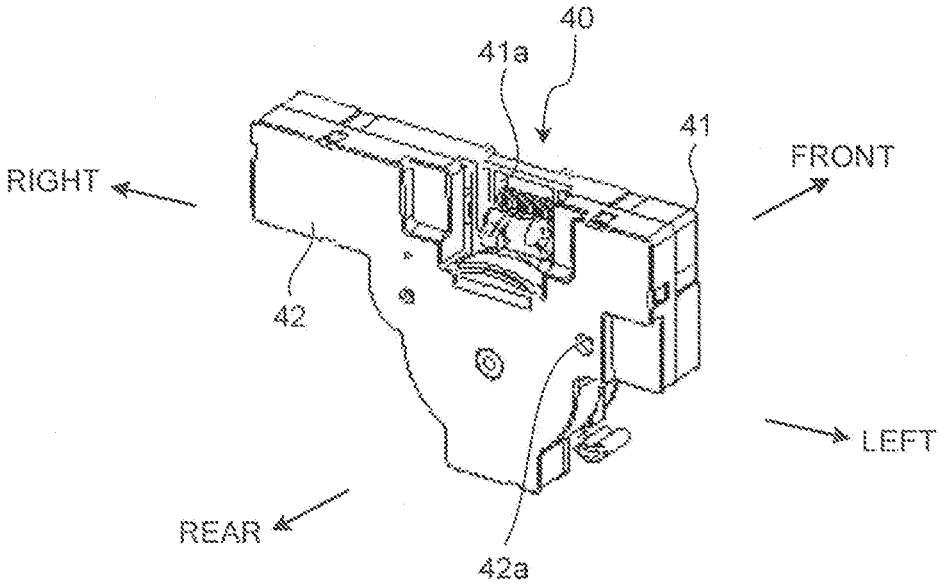
FIG. 8 is a perspective view illustrating principal parts of a drive unit in the first discharge mechanism when viewed from the rear-left side.
Figure 9:
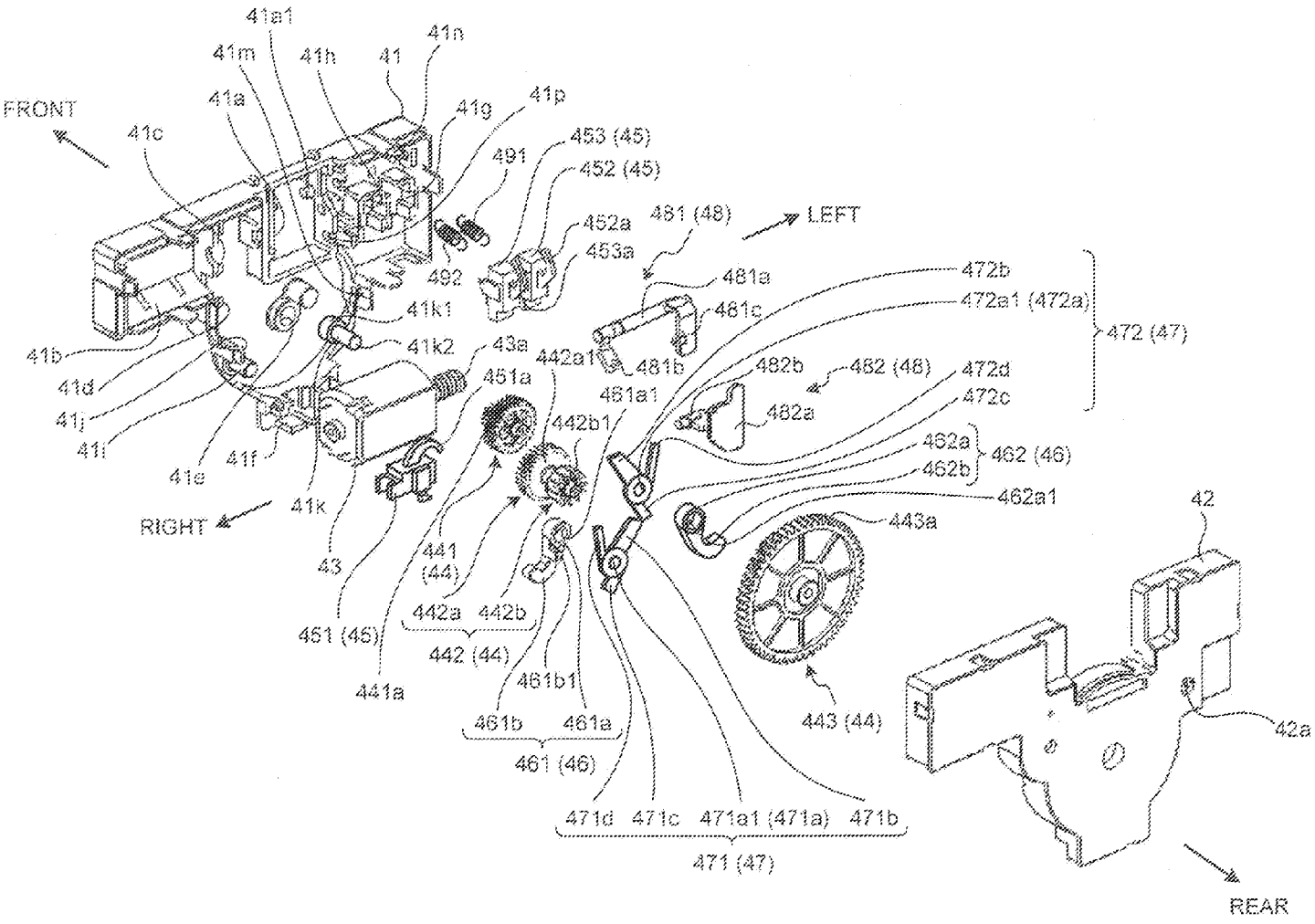
FIG. 9 is an exploded perspective view of principal parts of the drive unit in the first discharge mechanism.
Figure 10:
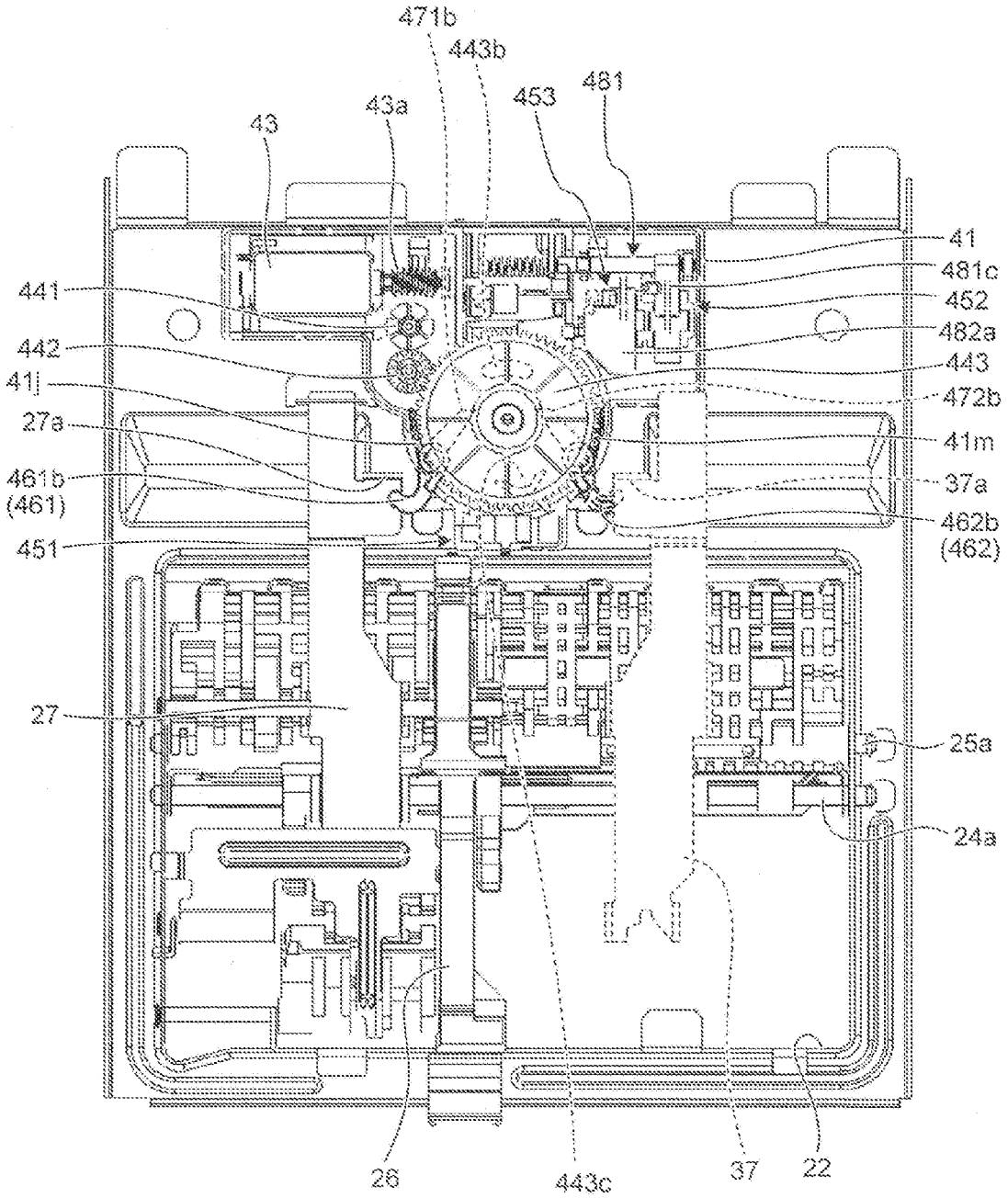
FIG. 10 is a rear view of the first discharge mechanism when viewed from the rear side.
Figure 11:
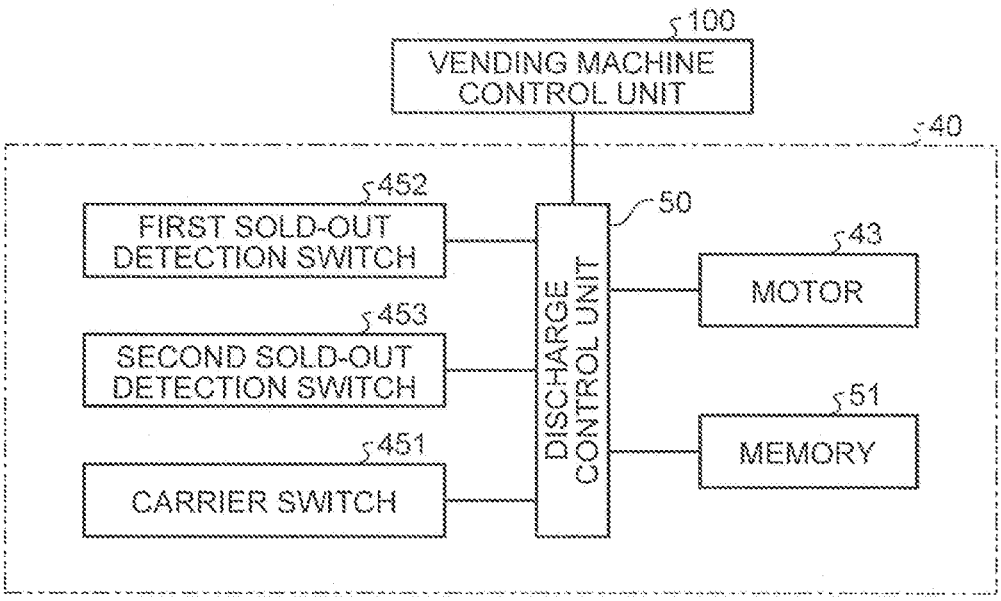
FIG. 11 is a block diagram schematically illustrating a characteristic control system of the drive unit.

The first discharge mechanism 20*a* having the above-mentioned configuration includes a drive unit 40 in addition to the above-mentioned configuration. FIGS. 8 and 9 illustrate principal parts of the drive unit 40 in the first discharge mechanism 20*a*, where FIG. 8 is a perspective view thereof when viewed from the rear-left side and FIG. 9 is an exploded perspective view thereof. FIG. 10 is a rear view illustrating the first discharge mechanism 20*a* when viewed from the rear side, in which some elements are not illustrated for the purpose of description. FIG. 11 is a block diagram schematically illustrating a characteristic control system of the drive unit 40.

The drive unit 40 is disposed in an area above the second swing support shaft 25*a* and immediately above the bearing portion 26 on the rear side of the base member 21. The drive unit 40 includes a unit base 41 which is attached to the rear surface of the base member 21.

The unit base 41 is formed of, for example, a resin material and is formed in a box shape of which the rear surface is opened. On the front surface of the unit base 41, a rectangular base opening 41*a* is formed in a portion corresponding to an upper opening 21*b* (see FIG. 4) disposed in the base member 21. In the unit base 41, the opening of the rear surface is closed by attaching a unit cover 42 formed of a resin thereto, thereby forming a storage space between the unit cover 42 and the unit base 41. A motor 43, a gear member 44, a switch member 45, a link lever member 46, an arm member 47, and a sold-out link lever member 48 are stored in the storage space formed by the unit base 41 and the unit cover 42.

The motor 43 serves as a drive source and is a DC motor that can rotate positively and reversely and that is driven in accordance with a command issued from a discharge control unit 50 as control means. The motor 43 is disposed in a state in which the motor 43 is held by a motor holding unit 41*b* of the unit base 41.

Here, the discharge control unit 50 comprehensively controls the operation of the drive unit 40 on the basis of a program or data stored in a memory 51 and can communicate with a vending machine control unit 100 that comprehensively controls the vending operation of the vending machine.

The gear member 44 includes a helical gear 441, an intermediate gear 442, and an output gear 443. The helical gear 441 has a disk shape, a hole portion (not illustrated) is formed at the center thereof, and a gear portion 441*a* including plural teeth is formed on the circumferential surface thereof. The helical gear 441 is disposed to be rotatable about the axis of a first gear shaft 41*c* by inserting the first gear shaft 41*c* of the unit base 41 into the hole portion in a state in which the gear portion 441*a* engages with an output shaft 43*a* of the motor 43.

The intermediate gear 442 includes a disk-like first intermediate gear 442*a* and a disk-like second intermediate gear 442*b* of which the diameter is smaller than that of the first intermediate gear 442*a*. In the first intermediate gear 442*a*, a hole portion (not illustrated) is formed at the center thereof and a gear portion 442*a*1 including plural teeth is formed on the circumferential surface thereof.

The second intermediate gear 442*b* is located on the rear side of the first intermediate gear 442*a* and is disposed such that the center thereof matches the center of the first intermediate gear 442*a*. A gear portion 442*b*1 including plural teeth is also formed on the circumferential surface of the second intermediate gear 442*b*. The intermediate gear 442 is disposed to be rotatable about the axis of a second gear shaft 41*d* by inserting the second gear shaft 41*d* of the unit base 41 into the hole portion in a state in which the gear portion 442*b*1 of the first intermediate gear 442*a* engages with the gear portion 441*a* of the helical gear 441.

The output gear 443 has a disk shape having a diameter larger than that of the helical gear 441 or the intermediate gear 442. A gear portion 443*a* including plural teeth is also formed on the circumferential surface of the output gear 443. Although not clearly illustrated in the drawings, an axial portion protruding to the front side is formed at the center of the output gear 443. An operation piece 443*b* and a pressing piece 443*c* are formed on the front surface of the output gear 443 (see FIG. 10).

The operation piece 443*b* has an arc shape and is formed to protrude to the front side. The length of the arc shape in the operation piece 443*b* is set to have a size sufficient for holding a state in which the pedal link member 27 (37) has moved upward. Although details thereof will be described later, the operation piece 443*b* is disposed in an area in which the operation piece does not come in contact with a contactor 451*a* of a carrier switch 451 constituting the switch member 45 in moving with the rotation of the output gear 443.

The pressing piece 443*c* has a substantially V shape when viewed from the rear side and is formed in the area opposite to the operation piece 443*b* to protrude to the front side. The front protruding length of the pressing piece 443*c* is set to be smaller than the operation piece 443*b*.

The output gear 443 is disposed to be rotatable about the axis of the axial portion by inserting the axial portion into a shaft hole 41*e* formed in the unit base 41 in a state in which the gear portion 443*a* engages with the gear portion 442*b*1 of the second intermediate gear 442*b*.

The switch member 45 includes a carrier switch 451, one sold-out detection switch (hereinafter, also referred to as a first sold-out detection switch) 452 corresponding to the first discharge mechanism 20*a*, and the other sold-out detection switch (hereinafter, also referred to as a second sold-out detection switch) 453 corresponding to the second discharge mechanism 20*b*.

The carrier switch 451 is a so-called push switch and includes a contactor 451*a*. The carrier switch 451 is disposed in the unit base 41 in a state in which the carrier switch is held by a carrier switch holding portion 41*f* slightly below the area in which the output gear 443 is disposed. The carrier switch 451 is switched to an ON state to supply details thereof as an ON signal to the discharge control unit 50 when the contactor 451*a* is pressed, and is switched to an OFF state when the contactor 451*a* is not pressed.

The first sold-out detection switch 452 is a so-called push switch and includes a contactor 452*a*. The first sold-out detection switch 452 is disposed in the unit base 41 in a state in which the first sold-out detection switch is held by a first sold-out detection switch holding portion 41*g*. The first sold-out detection switch 452 is switched to an ON state to supply details thereof as an ON signal to the discharge control unit 50 when the contactor 452*a* is pressed, and is switched to an OFF state when the contactor 452*a* is not pressed.

The second sold-out detection switch 453 is a so-called push switch and includes a contactor 453*a*. The second sold-out detection switch 453 is disposed in the unit base 41 in a state in which the second sold-out detection switch is held by a second sold-out detection switch holding portion 41*h* adjacent to the right side of the first sold-out detection switch holding portion 41*g*. The second sold-out detection switch 453 is switched to an ON state to supply details thereof as an ON signal to the discharge control unit 50 when the contactor 453*a* is pressed, and is switched to an OFF state when the contactor 453*a* is not pressed.

The link lever member 46 includes first link lever 461 and a second link lever 462. The first link lever 461 is formed of, for example, a resin material and a through-hole 461*a*1 is formed in a base end portion 461*a* thereof. The first link lever 461 has a hook shape in which a tip portion 461*b* extends obliquely downward to the right side from the base end portion 461*a* and is then curved obliquely upward to the right side. A protrusion 461*b*1 protruding to the rear side is formed in the tip portion 461*b* of the first link lever 461.

The second link lever 462 is formed of, for example, a resin material and a through-hole 462*a*1 is formed in a base end portion 462*a* thereof. The second link lever 462 has a hook shape in which a tip portion 462*b* extends obliquely downward to the left side from the base end portion 462*a* and is then curved obliquely upward to the left side. A protrusion (not illustrated) protruding to the front side is formed in the tip portion 462*b* of the second link lever 462.

The arm member 47 includes a first arm 471 and a second arm 472. The first arm 471 has a flat panel shape formed of, for example, a resin material and includes a first base portion 471*a*, a first contact portion 471*b*, a first operation portion 471*c*, and a first locking portion 471*d*.

The first base portion 471*a* includes a through-hole 471*a*1. The through-hole 471*a*1 has an inner diameter substantially equal to that of the through-hole 461*a*1 formed in the base end portion 461*a* of the first link lever 461. The first contact portion 471*b* is a long portion extending obliquely upward to the left side from the top of the first base portion 471*a*. The first operation portion 471*c* is a portion protruding obliquely downward to the right side from the bottom of the first base portion 471*a*. The first locking portion 471*d* is a portion extending upward to be adjacent to the first contact portion 471*b* from the top of the first base portion 471*a*.

The second arm 472 has a flat panel shape formed of, for example, a resin material and includes a second base portion 472*a*, a second contact portion 472*b*, a second operation portion 472*c*, and a second locking portion 472*d*.

The second base portion 472*a* includes a through-hole 472*a*1. The through-hole 472*a*1 has an inner diameter substantially equal to that of the through-hole 462*a*1 formed in the base end portion 462*a* of the second link lever 462. The second contact portion 472*b* is a long portion extending obliquely upward to the right side from the top of the second base portion 472*a*. The second operation portion 472*c* is a portion protruding obliquely downward to the left side from the bottom of the second base portion 472*a*. The second locking portion 472*d* is a portion extending upward to be adjacent to the second contact portion 472*b* from the top of the second base portion 472*a*.

The arm member 47 together with the link lever member 46 is disposed in the unit base 41 as follows.

The first arm 471 is disposed such that the through-hole 471*a*1 of the first base portion 471*a* matches the through-hole 461*a*1 of the base end portion 461*a* on the rear side of the first link lever 461. At this time, the first operation portion 471*c* of the first arm 471 comes in contact with the protrusion 461*b*1 of the first link lever 461 from the left side. The first arm 471 in this state is disposed to be rotatable about the axis of a first link shaft 41*i* between the unit base 41 and the output gear 443 by inserting the first link shaft 41*i* of the unit base 41 into the through-holes 461*a*1 and 471*a*1 in a state in which the first link lever 461 is interposed therebetween. In the first arm 471 disposed in the unit base 41 in this way, the first locking portion 471*d* comes in contact with a right regulation piece 41*j* formed in the unit base 41.

The second link lever 462 is disposed such that the through-hole 462*a*1 of the base end portion 462*a* matches the through-hole 472*a*1 of the second base portion 472*a* on the rear side of the second arm 472. At this time, the second operation portion 472*c* of the second arm 472 comes in contact with the protrusion of the second link lever 462 from the right side. The second link lever 462 in this state is disposed to be rotatable about the axis of a second link shaft 41*k* between the unit base 41 and the output gear 443 by inserting the second link shaft 41*k* of the unit base 41 into the through-holes 462*a*1 and 472*a*1 in a state in which the second arm 472 is interposed therebetween. In the second arm 472 disposed in the unit base 41 in this way, the second locking portion 472*d* comes in contact with a left regulation piece 41*m* formed in the unit base 41. The second link shaft 41*k* of the unit base 41 includes a base end portion 41*k*1 and a tip portion 41*k*2 having a diameter smaller than that of the base end portion 41*k*1. The outer diameter of the tip portion 41*k*2 is slightly smaller than the inner diameter of the through-holes 462*a*1 and 472*a*1 and the outer diameter of the base end portion 41*k*1 is larger than the inner diameter of the through-holes 462*a*1 and 472*a*1. Accordingly, the second link lever 462 and the second arm 472 inserted into the second link shaft 41*k* are disposed in a state in which both are inserted into the tip portion 41*k*2 of the second link shaft 41*k*. That is, a gap is formed between the second arm 472 and the unit base 41.

The sold-out link lever member 48 includes a first sold-out link lever 481 and a second sold-out link lever 482. The first sold-out link lever 481 includes a base portion 481*a* having a rod shape, a contact plate 481*b* extending obliquely downward to the rear side from the right end of the base portion 481*a*, and a pressing plate 481*c* extending downward from the left end of the base portion 481*a*. The first sold-out link lever 481 is disposed in the unit base 41 so as to be rotatable about the axis of the base portion 481*a* in a state in which the first sold-out link lever is held by a first sold-out link lever holding portion 41*n*.

Figure 12:
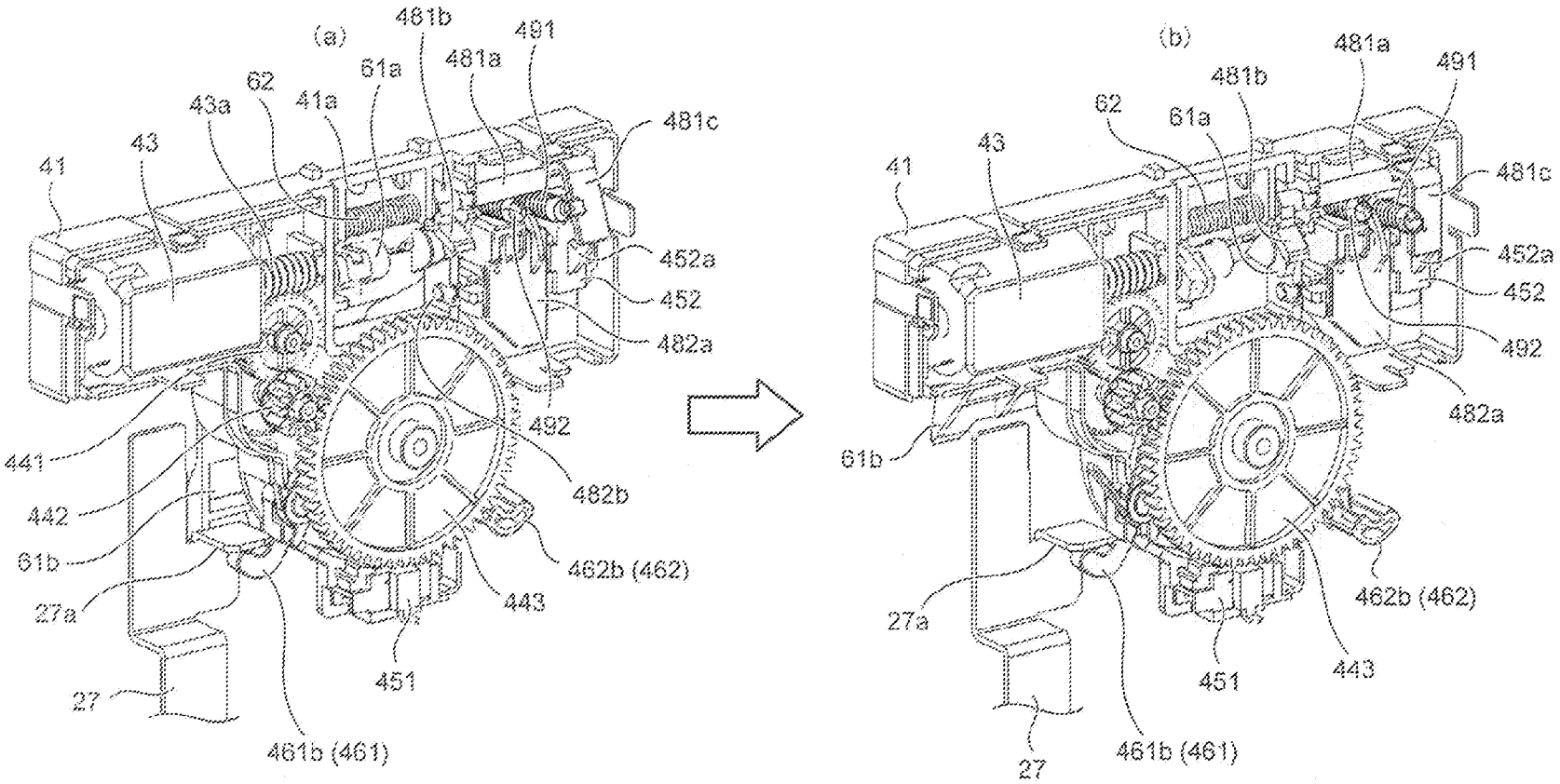
FIG. 12 is an enlarged perspective view illustrating principal parts of the first discharge mechanism, where FIG. 12(*a*) illustrates a state in which a sold-out detection lever retreats and FIG. 12(*b*) illustrates a state in which the sold-out detection lever advances.

At this time, a first sold-out link lever spring 491 is interposed between the pressing plate 481*c* of the first sold-out link lever 481 and the unit base 41, and the first sold-out link lever 481 is normally biased by the first sold-out link lever spring 491 such that the pressing plate 481*c* faces the front side. That is, as illustrated in (a) of FIG. 12, the first sold-out link lever 481 is biased to press the contactor 452*a* of the first sold-out detection switch 452. The contact plate 481*b* of the first sold-out link lever 481 is disposed at a position at which the base opening 41*a* can face the rear side (see (a) of FIG. 12).

The second sold-out link lever 482 includes a contact base plate 482*a* having a plate shape and a shaft portion 482*b* extending in the horizontal direction from the tip of an arm extending to the front side from the contact base plate 482*a*. The second sold-out link lever 482 is disposed in the unit base 41 so as to be rotatable about the axis of the shaft portion 482*b* by holding the shaft portion 482*b* using a second sold-out link lever holding portion 41*p*.

At this time, a second sold-out link lever spring 492 is interposed between the contact base plate 482*a* of the second sold-out link lever 482 and the unit base 41, and the second sold-out link lever 482 is normally biased by the second sold-out link lever spring 492 such that the contact base plate 482*a* faces the front side. That is, the second sold-out link lever is biased to press the contactor 453*a* of the second sold-out detection switch 453.

A sold-out detection lever (hereinafter, also referred to as a first sold-out detection lever) 61 corresponding to the first discharge mechanism 20*a* is disposed in the drive unit 40 having the above-mentioned configuration. The first sold-out detection lever 61 passes through the upper opening 21*b* of the base member 21 and the base opening 41*a* of the unit base 41 and is disposed to be swingable about the axis of a pair of right and left shaft protrusions 41*a*1 by causing the shaft protrusions 41*a*1 formed on both side surfaces of the base opening 41*a* of the unit base 41 to go into shaft holes formed on both right and left side surfaces of a base end portion 61*a*. Accordingly, a tip portion 61*b* of the first sold-out detection lever 61 can move advance into and retreat from the first product storage passage 13*a*.

A sold-out detection lever spring (hereinafter, also referred to as a first sold-out detection lever spring) 62 is interposed between the first sold-out detection lever 61 and the base member 21 (unit base 41). The first sold-out detection lever spring 62 normally biases the tip portion 61*b* of the first sold-out detection lever 61 so as to advance into the first product storage passage 13*a*.

In this way, the base end portion 61*a* does not come in contact with the contact plate 481*b* of the first sold-out link lever 481 when the tip portion 61*b* of the first sold-out detection lever 61 advances into the first product storage passage 13*a*, but the base end portion 61*a* comes in contact with the contact plate 481*b* of the first sold-out link lever 481 when the tip portion 61*b* retreats from the first product storage passage 13*a*. When the base end portion 61*a* comes in contact with the contact plate 481*b* in this way, the first sold-out link lever 481 rotates to the rear side about the axis against the biasing force of the first sold-out link lever spring 491.

Figure 13:
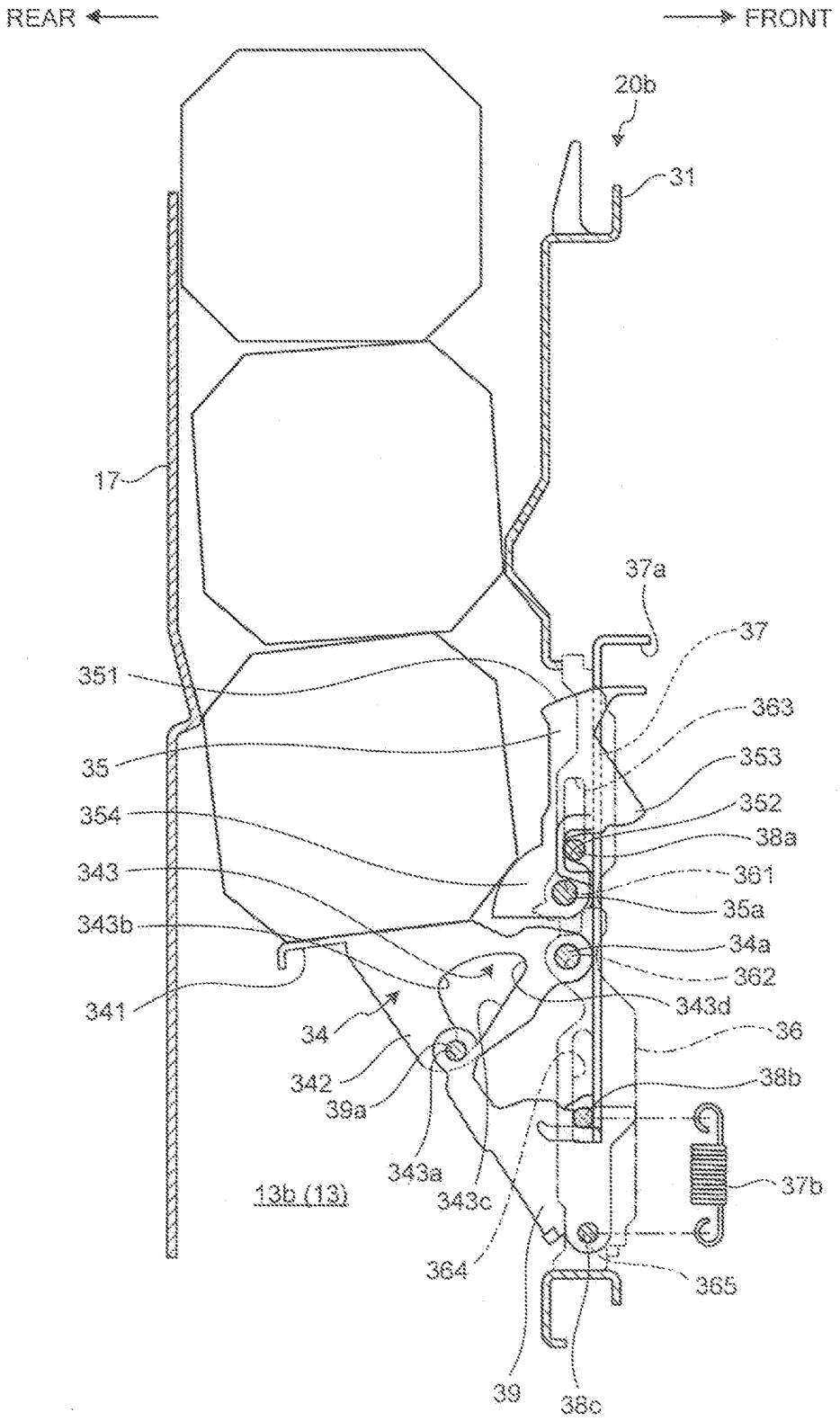
FIG. 13 is a diagram schematically illustrating principal parts of a second discharge mechanism (the other product discharging device) illustrated in FIGS. 2 to 4 when viewed from the left side.
Figure 14:
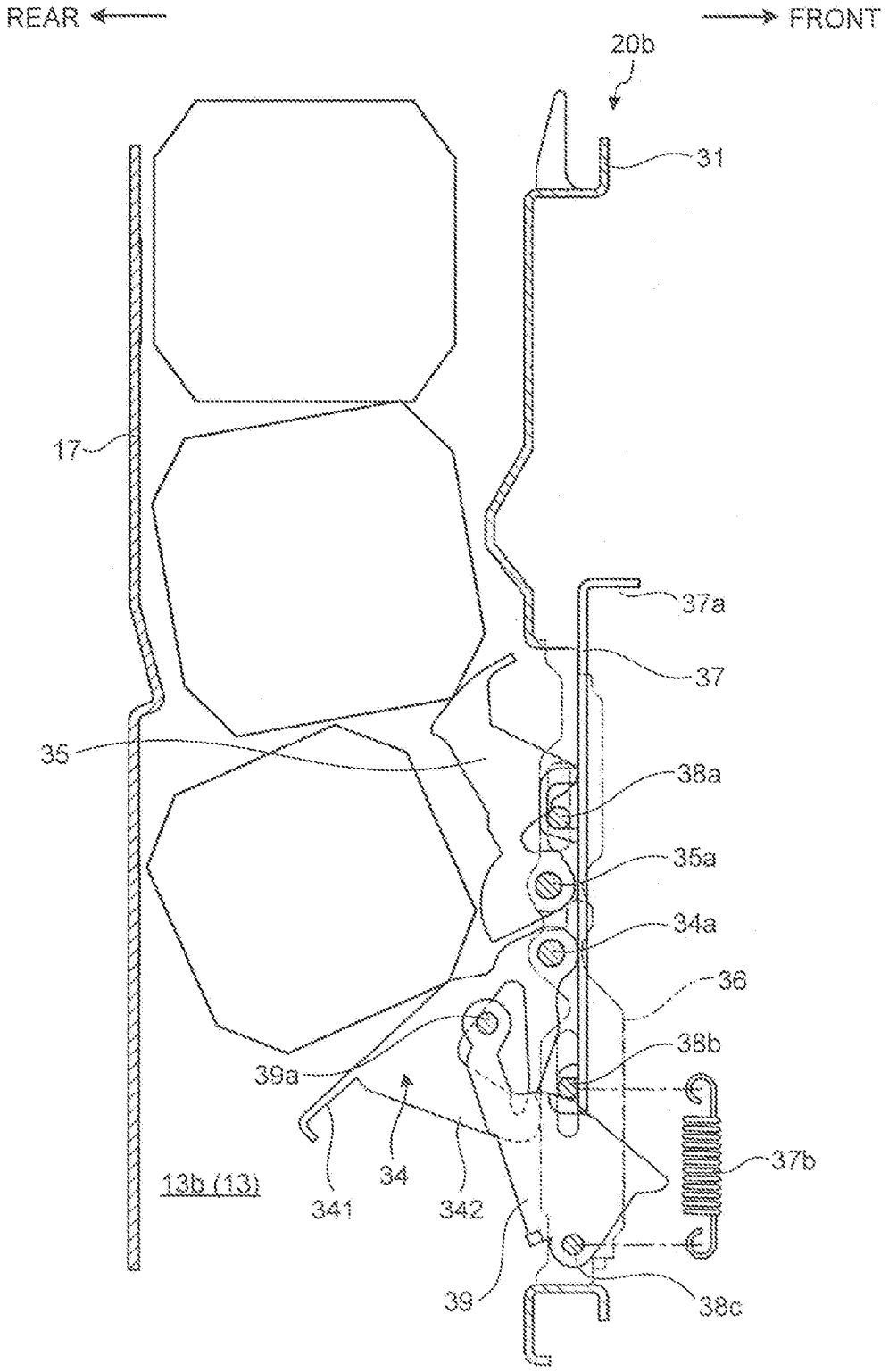
FIG. 14 is a diagram schematically illustrating principal parts of the second discharge mechanism illustrated in FIGS. 2 to 4 when viewed from the left side.
Figure 15:
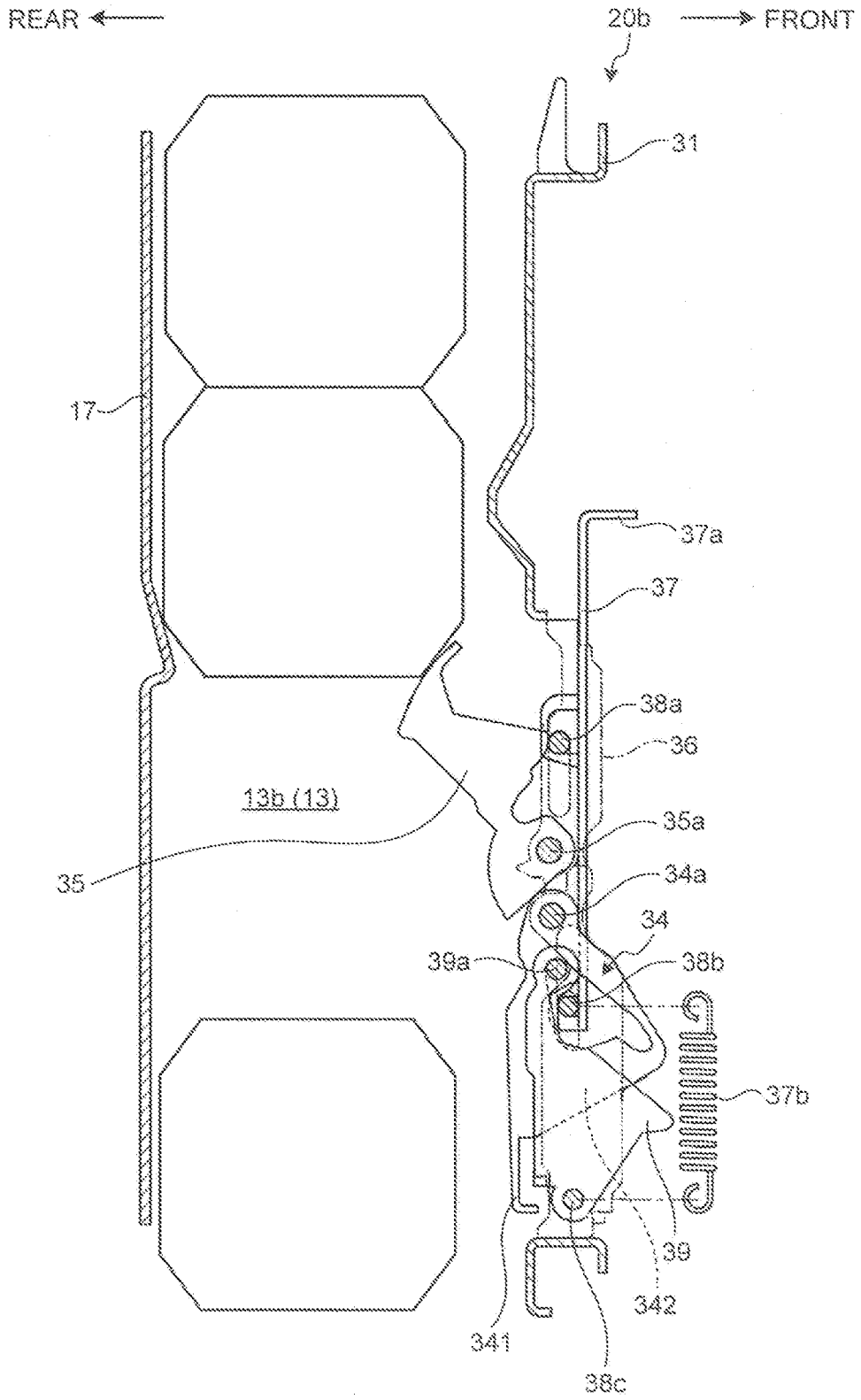
FIG. 15 is a diagram schematically illustrating principal parts of the second discharge mechanism illustrated in FIGS. 2 to 4 when viewed from the left side.

FIGS. 13 to 15 are diagrams schematically illustrating principal parts of the second discharge mechanism 20*b* illustrated in FIGS. 2 to 4 when viewed from the left side. In the following description, the structure of the second discharge mechanism 20*b* will be described appropriately with reference to FIGS. 13 to 15.

The second discharge mechanism 20*b* is applied to the second product storage passage 13*b* and is disposed in the bottom of the second product storage passage 13*b*. The second discharge mechanism 20*b* serves to store products in the second product storage passage 13*b* in a standby state and to discharge a product to the product chute 5 in a driven state by controlling behavior of product between the opposite passage width defining plate 17 and the second discharge mechanism, and includes a base member 31.

The base member 31 is formed by performing a cutting process and a bending process on a steel sheet and is disposed to cause its own surface to face the passage width defining plate 17, and an insertion hole 32 is formed in an intermediate portion thereof. The insertion hole 32 is a rectangular through-opening. A side wall 31*a* is formed on both sides of the base member 31 by bending both sides thereof.

A pair of right and left bearing pieces 33 disposed on both sides of the insertion hole 32 of the base member 31 is provided with a first swing support shaft 34*a* and a second swing support shaft 35*a*.

The first swing support shaft 34*a* is an axial member which is disposed to extend substantially in the horizontal direction and supports a lower pedal member 34 in the middle way. The second swing support shaft 35*a* is an axial member which is disposed above the first swing support shaft 34*a* so as to extend substantially in the horizontal direction and supports an upper pedal member 35 in the middle way.

The lower pedal member 34 is a plate-like member and is disposed in the base member to be swingable about the axis of the first swing support shaft 34*a* by inserting the first swing support shaft 34*a* into the base end portion thereof.

The tip portion of the lower pedal member 34 extends in the outer radial direction of the first swing support shaft 34*a*, and can advance into and retreat from the second product storage passage 13*b* via the insertion hole 32 when the lower pedal member swings about the axis of the first swing support shaft 34*a*. That is, the lower pedal member 34 is swingably disposed to advance into and retreat from the second product storage passage 13*b*.

A lower pedal member spring (not illustrated) is interposed between the lower pedal member 34 and the base member 31. The lower pedal member spring normally biases the lower pedal member 34 in the advancing direction to the second product storage passage 13*b*.

The lower pedal member 34 includes a plate-like pedal body 341 and a pair of guide portions 342. The pair of guide portions 342 is disposed on the rear side of the pedal body 341. Each guide portion 342 is a plate-like member extending in the up-and-down direction and both are formed to face each other. A guide groove 343 is formed on the facing surfaces of the guide portions 342.

The guide groove 343 includes a fitting portion 343*a* which is located at the lowest position in a state in which the lower pedal member 34 is disposed at a forward-moved position at which the lower pedal member most moves forward to the second product storage passage 13*b* (the state illustrated in FIG. 13) and into which a pedal operating shaft 39*a* of a rotation stopper member 39 to be described later is fitted, a contact portion 343*d* which is located at the highest position in a state in which the lower pedal member 34 is disposed at a backward-moved position at which the lower pedal member most retreats from the second product storage passage 13*b* (the state illustrated in FIG. 15) and with which the pedal operating shaft 39*a* of the rotation stopper member 39 comes in contact, and a first guide portion 343*b* and a second guide portion 343*c* which are continuously connected to the fitting portion 343*a* and the contact portion 343*d*.

The first guide portion 343*b* is formed in the guide portion 342 so as to be inclined obliquely upward from the fitting portion 343*a* so as to get away from the base member 31, be inclined obliquely upward so as to get close to the base member 31, and then reach the contact portion 343*d* in a state in which the lower pedal member 34 is located at the position (forward-moved position) at which the lower pedal member most advances into the second product storage passage 13*b*.

The second guide portion 343*c* is formed in the guide portion 342 so as to be inclined obliquely downward from the contact portion 343*d* so as to get away from the base member 31 and then reach the fitting portion 343*a* in a state in which the lower pedal member 34 is located at the position (forward-moved position) at which the lower pedal member most advances into the second product storage passage 13*b*.

The length in the outer radial direction of the lower pedal member 34 from the first swing support shaft 34*a* is set to a length with which a gap smaller than the maximum width of a product having a small maximum width can be secured between the passage width defining plate 17 and the lower pedal member as illustrated in FIG. 13 when the lower pedal member is located at the position (forward-moved position) at which the lower pedal member most advances into the second product storage passage 13*b*.

The upper pedal member 35 is a plate-like member and is disposed in the base member 31 so as to be swingable about the axis of the second swing support shaft 35*a* by inserting the second swing support shaft 35*a* into the base end portion thereof.

The tip portion of the upper pedal member 35 extends in an outer radial direction of the second swing support shaft 35*a*, and can advance into and retreat from the second product storage passage 13*b* via the insertion hole 32 when the upper pedal member swings about the axis of the second swing support shaft 35*a*. That is, the upper pedal member 35 is swingably disposed to advance into and retreat from the second product storage passage 13*b*.

An upper pedal member spring (not illustrated) is interposed between the upper pedal member 35 and the base member 31. The upper pedal member spring normally biases the upper pedal member 35 in the retreating direction to the second product storage passage 13*b*.

The upper pedal member 35 is provided with a pressing inclined surface 351, a concave portion 352, a stopper contact portion 353, and a protrusion 354. The pressing inclined surface 351 is disposed in the tip portion of the upper pedal member 35 and is a curved inclined surface which is formed to be gradually lowered toward the second product storage passage 13*b* when the upper pedal member 35 retreats from the second product storage passage 13*b*. The concave portion 352 is disposed on the rear side of the upper pedal member 35 and is a set of concave places extending substantially in the horizontal direction and being formed to be opened to both side surfaces of the upper pedal member 35. The stopper contact portion 353 is a portion with which a stopper pin 38*a* to be described later comes in contact and is disposed to be inclined to the upper side of the concave portion 352 on the rear surface of the upper pedal member 35.

The protrusion 354 is disposed in the base portion of the upper pedal member 35 so as to protrude toward the second product storage passage 13*b*.

The upper pedal member 35 is biased to retreat from the second product storage passage 13*b* by a biasing force of the upper pedal member spring and the initial position thereof is set in a state in which the upper pedal member retreats from the second product storage passage 13*b* by bringing the stopper pin 38*a* into contact with the concave portion 352.

The upper pedal member 35 is inclined to the rear side with respect to the vertical plane passing through the second swing support shaft 35*a* in a state in which the upper pedal member is located at the position (forward-moved position) at which the upper pedal member most advances into the second product storage passage 13*b* (the state illustrated in FIG. 15). The length in the outer radial direction of the upper pedal member 35 from the second swing support shaft 35*a* is set to a length with which a gap smaller than the maximum width of a product having a small maximum width can be secured between the passage width defining plate 17 and the upper pedal member in the state in which the upper pedal member is inclined to the rear side.

The base member 31 is provided with a bearing portion 36. The bearing portion 36 serves to guide movement of a pedal link member 37 in the up-and-down direction, is formed to extend in the up-and-down direction, and is disposed to vertically cross the insertion hole 32 such that one end thereof is attached to an upper edge of the insertion hole 32 and the other end is attached to a lower edge of the insertion hole 32.

The bearing portion 36 is formed of a resin material and includes a second swing support shaft insertion hole 361, a first swing support shaft insertion hole 362, a stopper pin insertion hole 363, a pedal stopper pin support groove 364, and a stopper support hole 365.

The second swing support shaft insertion hole 361 is a hole through which the second swing support shaft 35*a* is inserted and which axially supports the second swing support shaft 35*a*. The first swing support shaft insertion hole 362 is a hole through which the first swing support shaft 34*a* is inserted and which axially supports the first swing support shaft 34*a*. The first swing support shaft insertion hole 362 is formed below the second swing support shaft insertion hole 361.

The stopper pin insertion hole 363 is a hole which axially slidably supports a stopper pin 38*a* to be described later and is formed such that an extending length thereof in the up-and-down direction is larger than the diameter of the stopper pin 38*a* formed in an axial shape. Accordingly, the stopper pin insertion hole 363 allows movement of the stopper pin 38*a* in the up-and-down direction and is disposed in a substantially middle portion between the upper end of the bearing portion 36 and the portion in which the second swing support shaft insertion hole 361 is formed.

The pedal stopper pin support groove 364 is a hole which axially slidably supports a pedal stopper pin 38*b* to be described later and is formed such that an extending length thereof in the up-and-down direction is larger than the diameter of the pedal stopper pin 38*b* formed in an axial shape. Accordingly, the pedal stopper pin support groove 364 allows movement of the pedal stopper pin 38*b* in the up-and-down direction and is disposed in a substantially middle portion between the portion in which the first swing support shaft insertion hole 362 is formed and the lower end of the bearing portion 36.

The stopper support hole 365 is a hole that axially supports a stopper shaft 38*c* to be described later and is formed at the lower end of the bearing portion 36.

The stopper pin 38*a*, the pedal stopper pin 38*b*, and the stopper shaft 38*c* are disposed between one bearing piece 33 and the bearing portion 36.

The stopper pin 38*a* is an axial member that is disposed substantially in the horizontal direction between one bearing piece 33 and the bearing portion 36, one end of which is inserted into a stopper pin insertion hole (not illustrated) of the bearing piece 33 and the other end of which is inserted into the stopper pin insertion hole 363 of the bearing portion 36. The stopper pin 38*a* is coupled to a pedal link member 37 and is movable in the up-and-down direction in the stopper pin insertion hole 363 with the movement in the up-and-down direction of the pedal link member 37. The stopper pin 38*a* comes in contact with the concave portion 352 of the upper pedal member 35 located at the initial position.

The pedal stopper pin 38*b* is an axial member that is disposed substantially in the horizontal direction between one bearing piece 33 and the bearing portion 36, one end of which is inserted into a pedal stopper pin support groove (not illustrated) of the bearing piece 33 and the other end of which is inserted into the pedal stopper pin support groove 364 of the bearing portion 36. The pedal stopper pin 38*b* is coupled to the pedal link member 37 and is movable in the up-and-down direction in the pedal stopper pin support groove 364 with the movement in the up-and-down direction of the pedal link member 37. The circumferential surface of the pedal stopper pin 38*b* comes in contact with the inner circumferential surface of the pedal stopper pin support groove 364 when the pedal link member 37 moves in the up-and-down direction.

The stopper shaft 38*c* is an axial member that is disposed substantially in the horizontal direction between one bearing piece 33 and the bearing portion 36 and supports the rotation stopper member 39 in the middle way thereof.

The rotation stopper member 39 is disposed between one bearing piece 33 and the bearing portion 36 so as to insert the stopper shaft 38*c* into the base end portion thereof and to be swingable about an axis of the stopper shaft 38*c*.

The tip portion of the rotation stopper member 39 extends in the outer radial direction of the stopper shaft 38*c* and can advance into and retreat from the second product storage passage 13*b* via the insertion hole 32 when the rotation stopper member swings about the axis of the stopper shaft 38*c*.

The rotation stopper member 39 includes a pedal operating shaft 39*a* at the tip portion thereof. The pedal operating shaft 39*a* is an axial member that is disposed substantially in the horizontal direction and both ends thereof are fitted into the guide grooves 343 of the lower pedal member 34.

A pedal operating member spring (not illustrated) is interposed between the rotation stopper member 39 and the base member 31. The pedal operating member spring normally biases the rotation stopper member 39 in the advancing direction to the second product storage passage 13*b*.

The rotation stopper member 39 as described above is biased in the advancing direction to the second product storage passage 13*b* by the pedal operating member spring, movement in the retreating direction thereof is restrained by bringing the pedal stopper pin 38*b* into contact with a predetermined part on the rear side of the rotation stopper member 39, and the initial position thereof in the state in which the rotation stopper member advances into the second product storage passage 13*b* is set. Since the lower pedal member 34 is biased by the lower pedal member spring, the initial position of the rotation stopper member 39 is set to a position at which both ends of the pedal operating shaft 39*a* are located in the fitting portion 343*a* of the guide grooves 343 and the lower pedal member 34 advances into the second product storage passage 13*b*.

The pedal link member 37 is a long plate-like member that extends in the up-and-down direction and includes a claw 37*a* which is formed by bending a part of the upper portion to the front side. Although details thereof will be described later, the pedal link member 37 is movable in the up-and-down direction.

A link spring 37*b* is interposed between the pedal link member 37 and the base member 31. The link spring 37*b* normally biases the pedal link member 37 downward. Although not clearly illustrated in the drawings, a second link spring is interposed between the pedal link member 37 and the base member 31. One end of the second link spring is locked to an engagement hole formed at the lower end of the pedal link member 37 and the other end thereof is locked to the stopper shaft 38*c*. The second link spring normally prevents the engagement of the pedal link member 37 and the pedal stopper pin 38*b* from being released by its own elastic force.

In a state in which the pedal link member 37 is biased by the link spring 37*b* and is located on the lower side, the stopper pin 38*a* is disposed at the lower end of the stopper pin insertion hole 363 and the pedal stopper pin 38*b* is disposed at the lower end of the pedal stopper pin support groove 364. In this state, the concave portion 352 of the upper pedal member 35 disposed at the backward-moved position comes in contact with the stopper pin 38*a*. The rotation stopper member 39 disposed at the forward-moved position comes in contact with the pedal stopper pin 38*b* to restrain the retreat movement of the rotation stopper member 39. The pedal operating shaft 39*a* of the rotation stopper member 39 disposed at the forward-moved position is fitted into the fitting portion 343*a* of the lower pedal member 34 to restrain the retreat movement of the lower pedal member 34 disposed at the forward-moved position.

On the other hand, in the state in which the pedal link member 37 is located on the upper side against the biasing force of the link spring 37*b*, as illustrated in FIG. 15, the stopper pin 38*a* is disposed at the upper end of the stopper pin insertion hole 363 and the pedal stopper pin 38*b* is disposed at the upper end of the pedal stopper pin support groove 364. In this state, the stopper contact portion 353 of the upper pedal member 35 comes in contact with the stopper pin 38*a* to restrain the retreat movement of the upper pedal member 35, and the upper pedal member 35 advances against the biasing force of the upper pedal member spring and is disposed at the forward-moved position.

On the other hand, since the restraining of the retreat movement due to the pedal stopper pin 38*b* is released, the restraining of the retreat movement of the rotation stopper member 39 with respect to the stopper shaft 38*c* is released. Here, the weight of a product coming in contact with the lower pedal member 34 maintained at the forward-moved position by the rotation stopper member 39 is applied to the rotation stopper member 39, and the rotation stopper member 39 starts its retreat movement with releasing the restraining of the retreat movement by the pedal stopper pin 38*b*. When the retreat movement of the rotation stopper member 39 is started, the pedal operating shaft 39*a* departs from the fitting portion 343*a* of the lower pedal member 34. Accordingly, the lower pedal member 34 is allowed to retreat about the first swing support shaft 34*a* and retreats against the elastic biasing force of the lower pedal member spring by the weight of the product.

The second discharge mechanism 20*b* having the above-mentioned configuration includes a sold-out detection lever (hereinafter, also referred to as a second sold-out detection lever) 71 in addition to the above-mentioned configuration.

The second sold-out detection lever 71 passes through an upper opening 31*b* of the base member 31 and is disposed to be swingable about the axes of shaft protrusions by causing the shaft protrusions (not illustrated) of a support pieces 31*c* disposed on both side edges of the upper opening 31*b* to go into shaft holes (not illustrated) formed on both right and left side surfaces of a base end portion 71*a*. Accordingly, a tip portion 71*b* of the second sold-out detection lever 71 can advance into and retreat from the second product storage passage 13*b*.

A sold-out detection lever spring (hereinafter, also referred to as a second sold-out detection lever spring) 72 (see FIG. 4) is interposed between the second sold-out detection lever 71 and the base member 31. The second sold-out detection lever spring 72 normally biases the tip portion 71*b* (see FIG. 2) of the second sold-out detection lever 71 so as to advance into the second product storage passage 13*b*.

A lever protrusion 73 is disposed on the rear surface (the surface on the front side) of the tip portion 71*b* of the second sold-out detection lever 71. The lever protrusion 73 is adjusted to a length with which the lever protrusion can be inserted through a communication hole 31*d* of the base member 31 and a cover hole 42*a* formed in the unit cover 42 of the drive unit 40 and can come in contact with the contact base plate 482*a* of the second sold-out link lever 482 of the drive unit 40 when the second sold-out detection lever 71 retreats from the second product storage passage 13*b*.

The product dispensing device 20 is constituted by coupling the first discharge mechanism 20*a* and the second discharge mechanism 20*b*, which have the above-mentioned configurations, to each other back to back. In this case, as illustrated in FIG. 10, the tip portion 461*b* of the first link lever 461 constituting the drive unit 40 is located in an area below the claw 27*a* of the pedal link member 27 and the tip portion 462*b* of the second link lever 462 is located in an area below the claw 37*a* of the pedal link member 37.

The product dispensing device 20 having the above-mentioned configuration operates as follows in the standby state.

In the drive unit 40 of the first discharge mechanism 20*a*, as illustrated in FIG. 10, the operation piece 443*b* of the output gear 443 is located at the highest position and the pressing piece 443*c* presses the contactor 451*a* of the carrier switch 451. In this case, the carrier switch 451 is in the ON state. In this standby state, the tip portion 461*b* of the first link lever 461 constituting the drive unit 40 is located at a position separated downward from the claw 27*a* of the pedal link member 27 and the tip portion 462*b* of the second link lever 462 is located at a position separated downward from the claw 37*a* of the pedal link member 37.

Accordingly, in the first discharge mechanism 20*a*, the pedal link member 27 is disposed on the lower side. Since the pedal link member 27 is disposed on the lower side in this way, as illustrated in FIG. 5, the pedal stopper pin 28*b* is disposed at the restraining position to restrain the retreat movement of the rotation stopper member 29. Accordingly, the pedal operating shaft 29*a* of the rotation stopper member 29 of which the retreat movement is restrained is fitted into the fitting portion 243*a* of the guide groove 243 of the lower pedal member 24 and the retreat movement of the lower pedal member 24 disposed at the forward-moved position is restrained. As a result, the downward movement of the lowest product coming in contact with the lower pedal member 24 is restrained and the products are stored with a sideways posture in the first product storage passage 13*a*. In this standby state, the upper pedal member 25 is biased by the upper pedal member spring and the stopper pin 28*a* comes in contact with the concave portion 252, whereby the upper pedal member waits at the initial position (standby position) to which the upper pedal member retreat from the first product storage passage 13*a*.

In the first discharge mechanism 20*a*, the first sold-out detection lever 61 is also pressed by the products stored in the first product storage passage 13*a* and retreat from the first product storage passage 13*a* against the biasing force of the first sold-out detection lever spring 62. When the first sold-out detection lever 61 retreat from the first product storage passage 13*a* in this way, the base end portion 61*a* of the first sold-out detection lever 61 comes in contact with the contact plate 481*b* of the first sold-out link lever 481. Accordingly, as illustrated in (a) of FIG. 12, the first sold-out link lever 481 rotates backward about the axis against the biasing force of the first sold-out link lever spring 491 and the pressing plate 481*c* is separated from the contactor 452*a* of the first sold-out detection switch 452. Accordingly, the first sold-out detection switch 452 is in the OFF state.

On the other hand, also in the second discharge mechanism 20*b*, the pedal link member 37 is disposed on the lower side. Accordingly, as illustrated in FIG. 13, the pedal stopper pin 38*b* is disposed at the restraining position to restrain the retreat movement of the rotation stopper member 39. Accordingly, the pedal operating shaft 39*a* of the rotation stopper member 39 of which the retreat movement is restrained is fitted into the fitting portion 343*a* of the guide groove 343 of the lower pedal member 34 and the retreat movement of the lower pedal member 34 disposed at the forward-moved position is restrained. As a result, the downward movement of the lowest product coming in contact with the lower pedal member 34 is restrained and the products are stored with a sideways posture in the second product storage passage 13*b*. In this standby state, the upper pedal member 35 is biased by the upper pedal member spring and the stopper pin 38*a* comes in contact with the concave portion 352, whereby the upper pedal member waits at the initial position (standby position) to which the upper pedal member retreats from the second product storage passage 13*b*.

Figure 16:
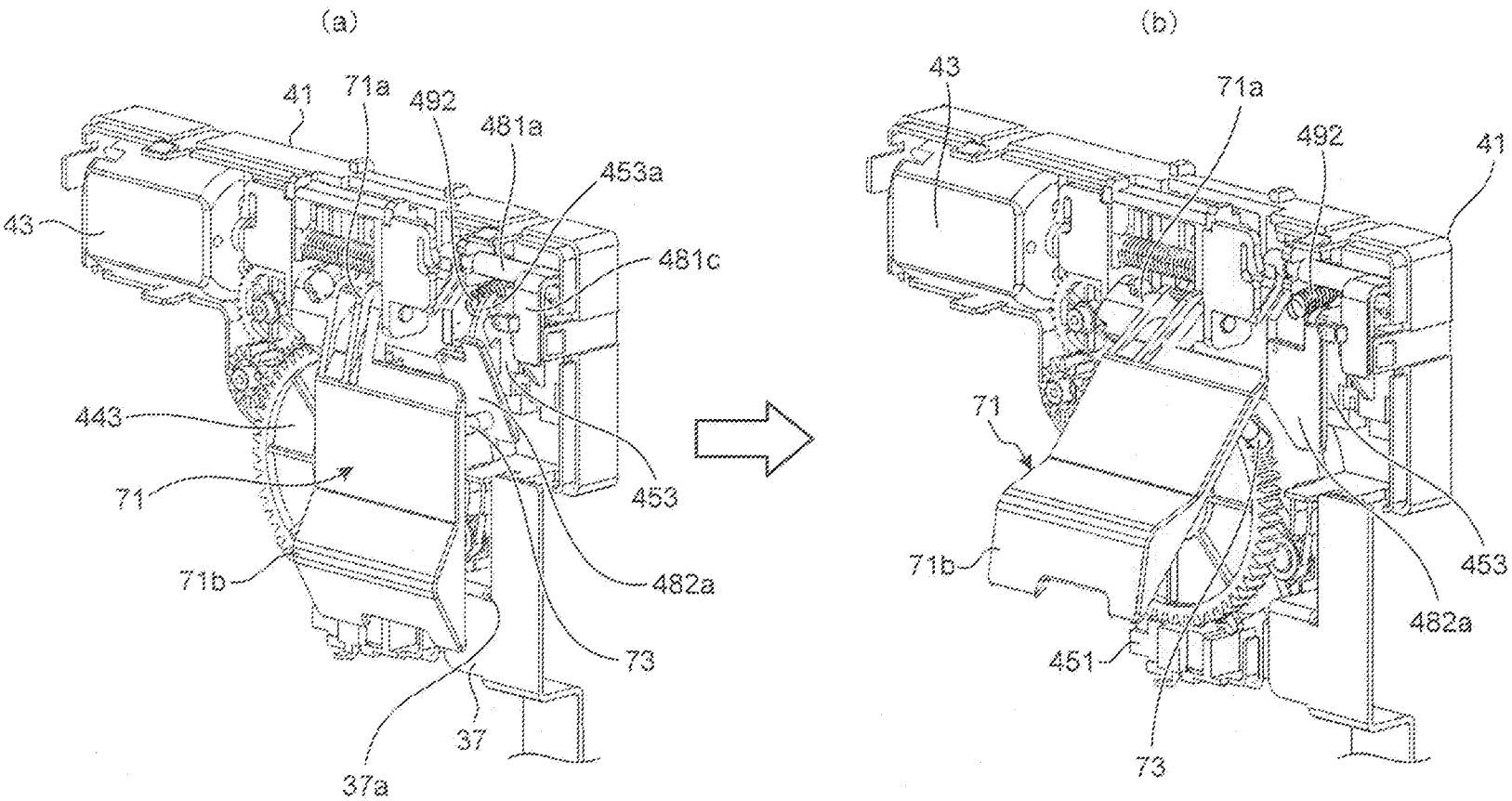
FIG. 16 is an enlarged perspective view illustrating principal parts of the first discharge mechanism, where FIG. 16(*a*) illustrates a state in which a sold-out detection lever disposed in the second discharge mechanism retreats and FIG. 12(*b*) illustrates a state in which the sold-out detection lever disposed in the second discharge mechanism advances.

In the second discharge mechanism 20*b*, the second sold-out detection lever 71 is also pressed by the products stored in the second product storage passage 13*b* and retreats from the second product storage passage 13*b* against the biasing force of the second sold-out detection lever spring 72. When the second sold-out detection lever 71 retreats from the second product storage passage 13*b* in this way, the lever protrusion 73 of the second sold-out detection lever 71 is inserted through the communication hole 31*d* and the cover hole 42*a* and comes in contact with the contact base plate 482*a* of the second sold-out link lever 482. Accordingly, as illustrated in (a) of FIG. 16, the second sold-out link lever 482 rotates backward about the axis against the biasing force of the second sold-out link lever spring 492 and the contact base plate 482*a* is separated from the contactor 453*a* of the second sold-out detection switch 453. Accordingly, the second sold-out detection switch 453 is in the OFF state.

In this standby state, when a discharge command is issued from the vending machine control unit 100 to the discharge control unit 50 by a user's operation of purchasing product, the product dispensing device 20 operates as follows.

Figure 17:
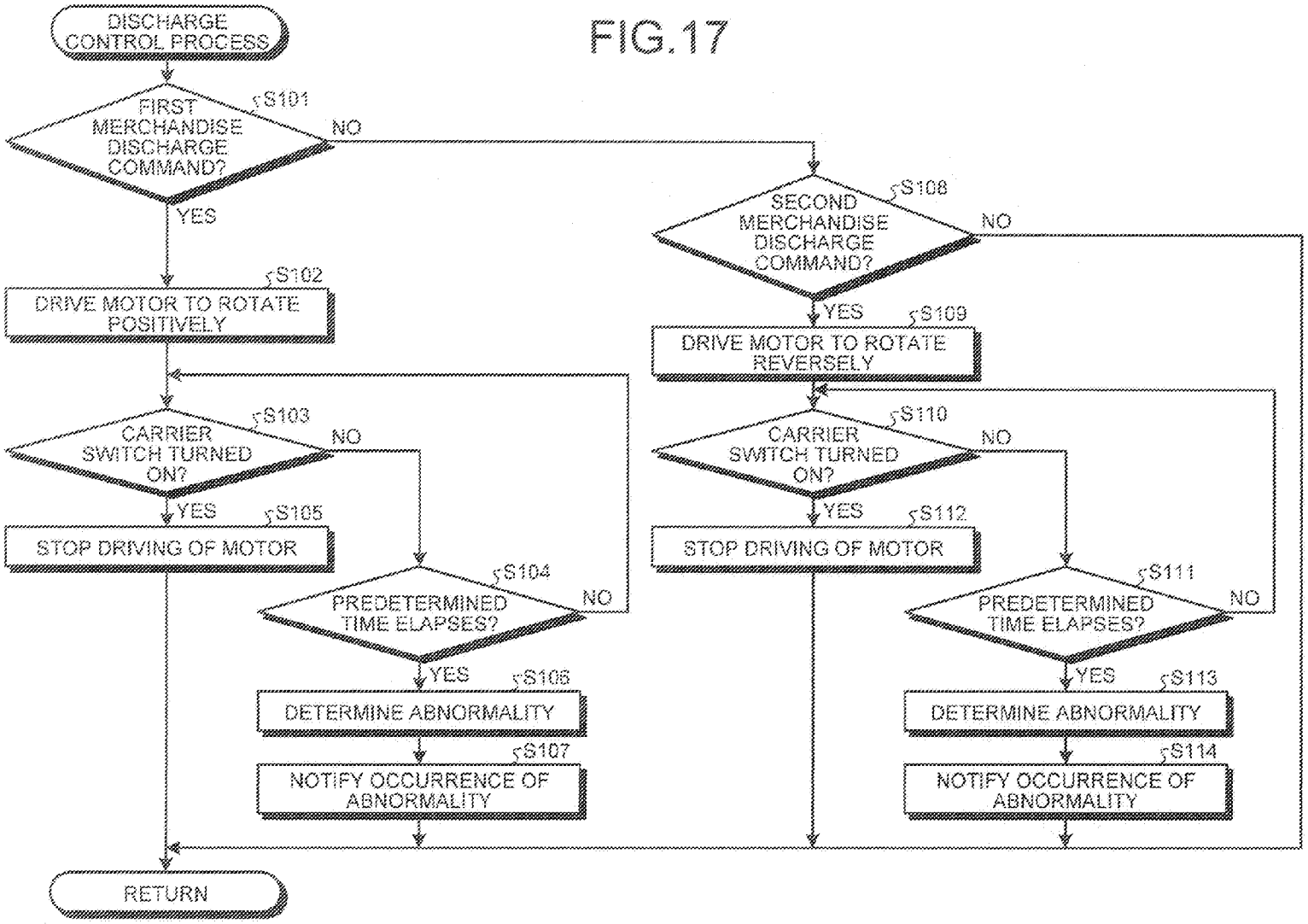
FIG. 17 is a flowchart illustrating process details of a discharge control process which is performed by a discharge control unit of the product dispensing device.

FIG. 17 is a flowchart illustrating process details of a discharge control process which is performed by the discharge control unit 50 of the product dispensing device 20. The operation of the product dispensing device 20 will be described below while describing the discharge control process. In the following description, the product stored in the first product storage passage 13*a* is also referred to as "first product" and the product stored in the second product storage passage 13*b* is also referred to as "second product".

In the discharge control process, when a discharge command of the first product is issued from the vending machine control unit 100 (YES in step S101), the discharge control unit 50 drives the motor 43 to rotate positively (step S102).

Figures 1, 18:
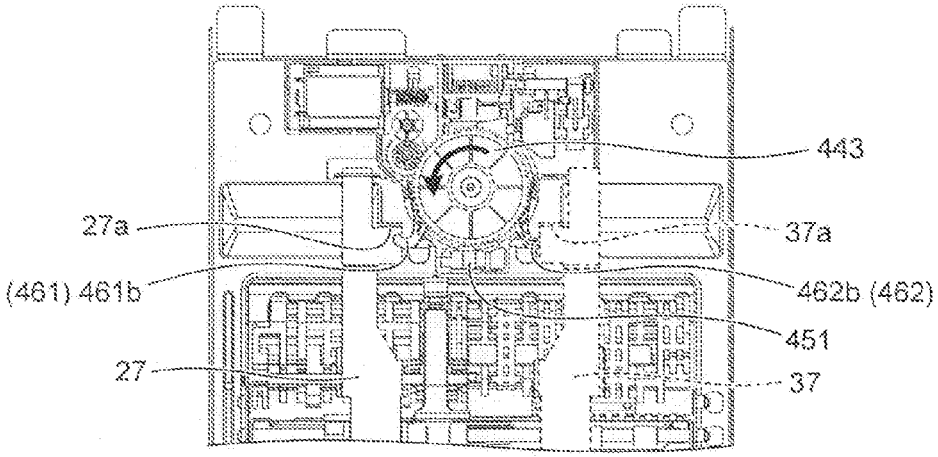
Figures 2, 18:
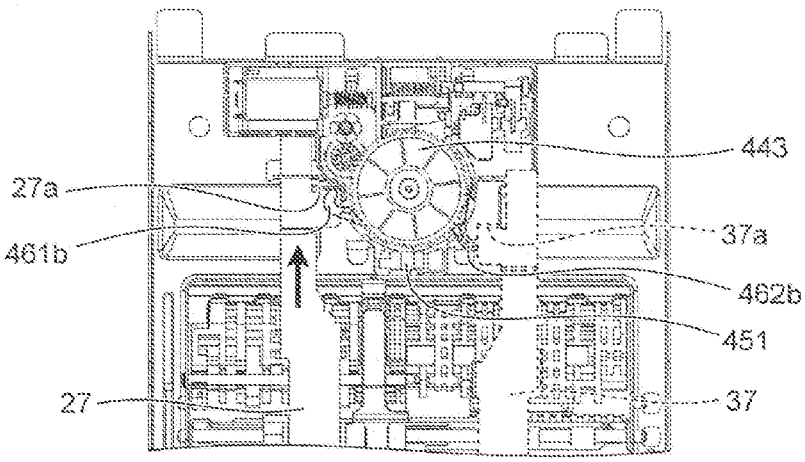
Figures 3, 18:
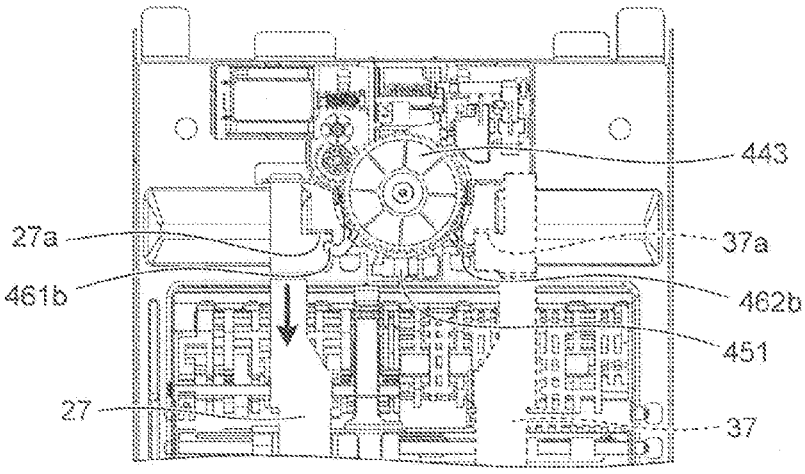
Figures 1, 19:
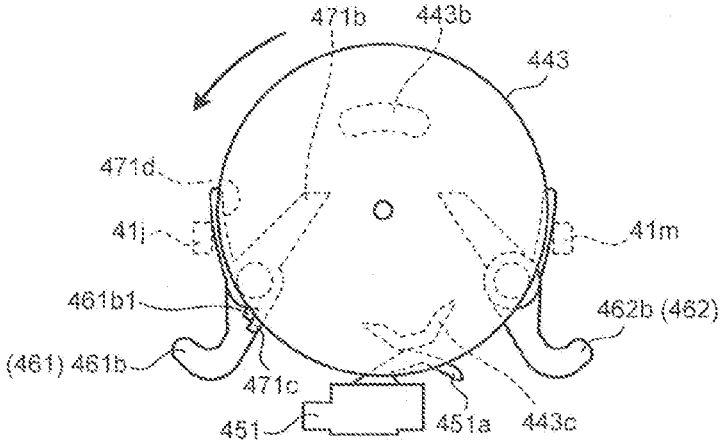
Figures 2, 19:
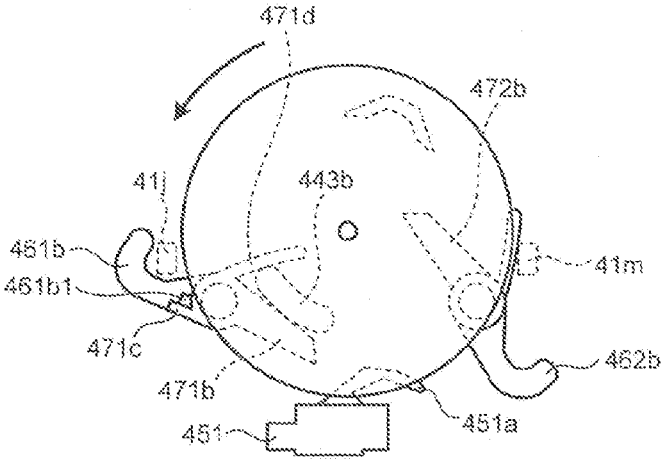
Figures 3, 19:
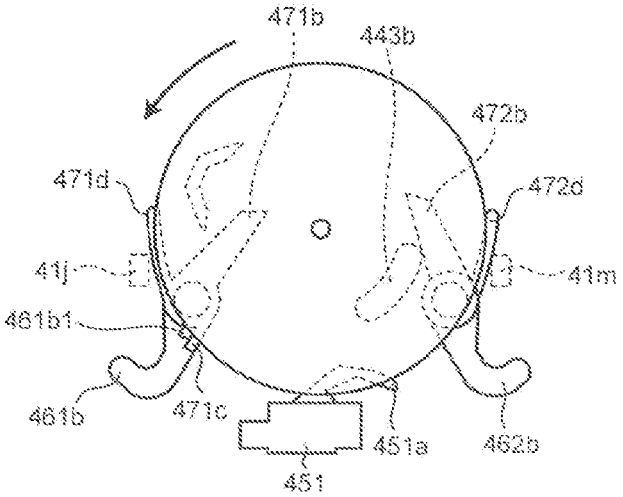

When the motor 43 is driven to rotate positively in this way, the output gear 443 to which the driving force of the motor 43 is transmitted via the helical gear 441 and the intermediate gear 442 rotates counterclockwise in a rear view as illustrated in FIGS. 18-1 and 19-1.

When the output gear 443 rotates counterclockwise in a rear view, the pressing piece 443*c* of the output gear 443 departs from the contactor 451*a* of the carrier switch 451. Accordingly, the contactor 451*a* of the carrier switch 451 is released from the pressed state and is switched to the OFF state.

When the operation piece 443*b* comes in contact with the first contact portion 471*b* of the first arm 471 from the upper side by the rotation of the output gear 443 as illustrated in FIG. 19-2, the first arm 471 rotates about the axis clockwise in a rear view. When the first arm 471 rotates clockwise, the first operation portion 471*c* presses the protrusion 461*b*1 of the first link lever 461 and the first link lever 461 also rotates clockwise in a rear view together with the first arm 471. When the first link lever 461 rotates clockwise in this way, the tip portion 461*b* moves upward. When the tip portion 461*b* moves upward in this way, as illustrated in FIG. 18-2, the tip portion comes in contact with the claw 27*a* of the pedal link member 27 to cause the pedal link member 27 to move upward against the biasing force of the link spring 27*b* by a predetermined distance (for example, about 15 mm). While the operation piece 443*b* comes in sliding contact with the first contact portion 471*b*, the state in which the pedal link member 27 moves upward by the predetermined distance can be maintained.

With the upward movement of the pedal link member 27, the stopper pin 28*a* moves upward from the lower end of the stopper pin insertion hole 263 and the pedal stopper pin 28*b* moves upward from the lower end of the pedal stopper pin support groove 264.

At this time, since the stopper pin 28*a* moves upward while coming in contact with the stopper contact portion 253 of the upper pedal member 25, the upper pedal member 25 advances into from the initial position against the biasing force of the upper pedal member spring as illustrated in FIG. 6. The advancing movement of the upper pedal member 25 is performed along with the upward movement of the stopper pin 28*a*.

As illustrated in FIG. 7, the upper pedal member 25 moving upward comes in contact with a second lowest piece of first product (hereinafter, also referred to as next product) to restrain downward movement of the next product.

On the other hand, since the weight of the product coming in contact with the lower pedal member 24 maintained at the forward-moved position is applied to the rotation stopper member 29, the rotation stopper member 29 starts its retreat movement by releasing the restraining of the retreat movement due to the upward movement of the pedal stopper pin 28*b*.

When the rotation stopper member 29 starts the retreat movement in this way, the pedal operating shaft 29*a* departs from the fitting portion 243*a* and the lower pedal member 24 starts its retreat movement against the biasing force of the lower pedal member spring with the weight of the product. The pedal operating shaft 29*a* of the rotation stopper member 29 departing from the fitting portion 243*a* moves to a position at which the first guide portion 243*b* and the second guide portion 243*c* intersect each other along the first guide portion 243*b*.

Thereafter, the lower pedal member 24 retreats with the weight of the lowest product, the downward movement of the lowest product is allowed as illustrated in FIG. 7, and the lowest product is discharged downward. The discharged product is guided to the product discharge port 3*a* via the product chute 5 and can be taken out via the product output port 2*a*.

When the lowest product passes through the lower pedal member 24, the lower pedal member 24 moves to the forward-moved position with the elastic biasing force of the lower pedal member spring and the rotation stopper member 29 also moves to the forward-moved position with the elastic biasing force of the pedal operation member spring. When the lower pedal member 24 and the rotation stopper member 29 move to the forward-moved position, the pedal operating shaft 29*a* held at the position at which the first guide portion 243*b* and the second guide portion 243*c* intersect each other moves to the fitting portion 243*a* along the second guide portion 243*c*, and the lower pedal member 24 and the rotation stopper member 29 are returned to the forward-moved position.

In the meantime, the pedal link member 27 moves upward, the stopper pin 28*a* is located at the upper end of the stopper pin insertion hole 263, and the pedal stopper pin 28*b* is located at the upper end of the pedal stopper pin support groove 264.

Thereafter, when the contact of the operation piece 443*b* with the first contact portion 471*b* is released with the rotation of the output gear 443, as illustrated in FIG. 18-3, the pedal link member 27 is biased to move downward by the link spring 27*b*.

With the downward movement of the pedal link member 27, the stopper pin 28*a* moves downward from the upper end of the stopper pin insertion hole 263, and the pedal stopper pin 28*b* moves downward from the upper end of the pedal stopper pin support groove 264.

When the pedal stopper pin 28*b* moves downward, the pedal stopper pin 28*b* comes in contact with a predetermined portion on the rear surface of the rotation stopper member 29 returned to the forward-moved position. Accordingly, movement in the retreating direction is restrained and the initial position of the lower pedal member 24 is set to the position to which the lower pedal member advances into the first product storage passage 13*a*.

On the other hand, the upper pedal member 25 is biased by the upper pedal member spring and retreats with the downward movement of the stopper pin 28*a*. Accordingly, the downward movement of the next product is allowed, then the next product comes in contact with the lower pedal member 24, which had been advanced into the first product storage passage 13*a*, to restrain the downward movement thereof, and the standby state is started again.

In the drive unit 40, the operation piece 443*b* comes in contact with the second contact portion 472*b* of the second arm 472 with the counterclockwise rotation of the output gear 443. In this case, since the second locking portion 472*d* comes in contact with the left regulation piece 41*m* formed in the unit base 41, the rotation of the second arm 472 about the axis is restrained. Accordingly, as illustrated in FIG. 19-3, the second contact portion 472*b* is elastically deformed to get close to the second locking portion 472*d*, thereby not interfering with the movement of the operation piece 443*b* due to the rotation of the output gear 443.

Thereafter, when the operation piece 443*b* is returned to the position of the standby state illustrated in FIG. 19-1 with the rotation of the output gear 443, the pressing piece 443*c* presses the contactor 451*a* of the carrier switch 451 to switch the carrier switch 451 to the ON state.

In the above-mentioned positive rotation driving of the motor 43 in step S102, the discharge control unit 50 monitors whether the carrier switch 451 is switched to the ON state at a predetermined time (steps S103 and S104). That is, the discharge control unit monitors whether the output gear 443 rotates by one turn within a predetermined time.

As a result, when the carrier switch 451 is switched to the ON state within the predetermined time (YES in step S103 and NO in step S104), the discharge control unit 50 stops the positive rotation driving of the motor 43 (step S105), the process flow is returned, and this process flow is ended. Accordingly, the first product of which the discharge command is issued can be discharged well as described above.

When the carrier switch 451 is not switched to the ON state within the predetermined time, that is, when an ON signal is not output from the carrier switch 451 within the predetermined time (NO in step S103 and YES in step S104), the discharge control unit 50 determines that abnormality occurs (step S106). Then, the discharge control unit 50 notifies the vending machine control unit 100 of the occurrence of abnormality (step S107), the process flow is returned, and this process flow is ended. According to this configuration, it is possible to recognize the occurrence of abnormality in the first product storage passage 13*a* and to stop selling of the first product by lighting a sold-out lamp.

On the other hand, when a discharge command of the second product is issued from the vending machine control unit 100 (NO in step S101 and YES in step S108), the discharge control unit 50 drives the motor 43 to rotate reversely (step S109).

Figures 1, 20:
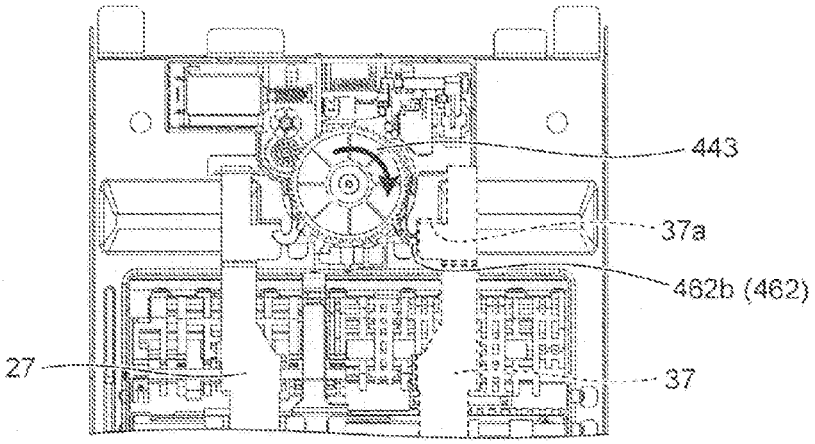
Figures 2, 20:
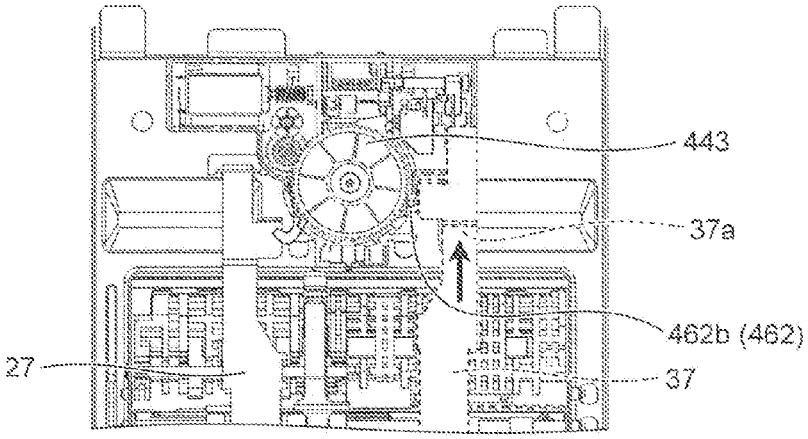
Figures 3, 20:
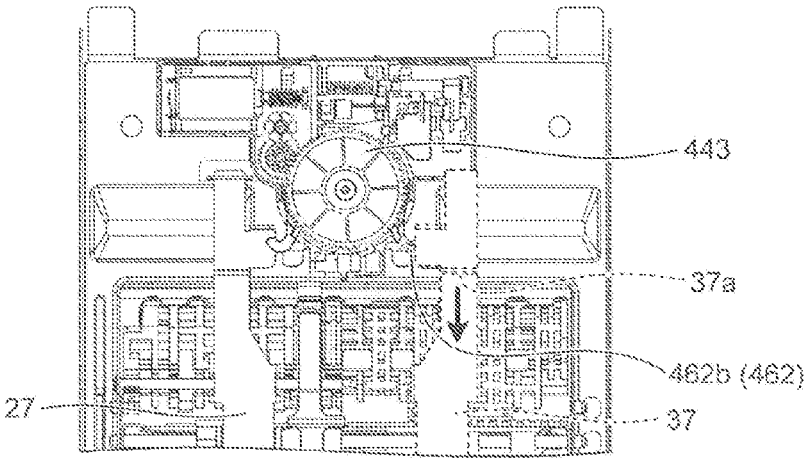
Figures 1, 21:
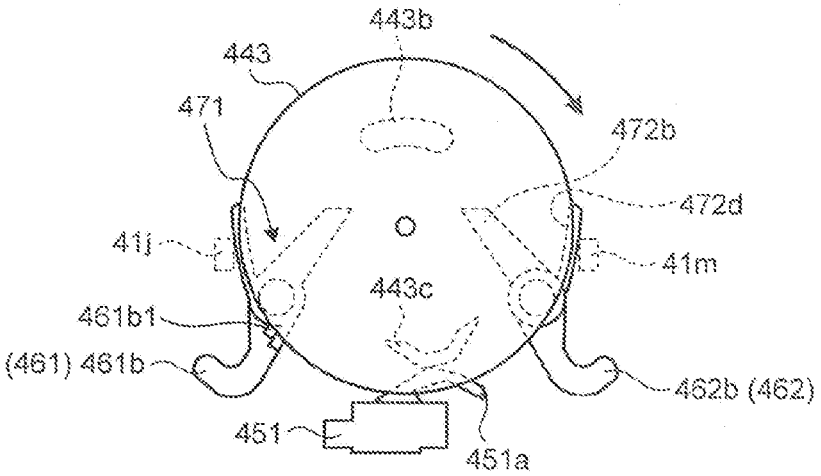
Figures 2, 21:
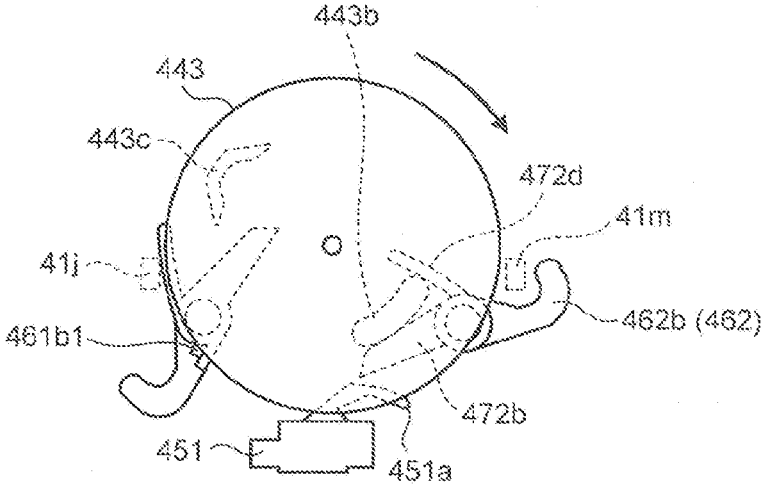
Figures 3, 21:
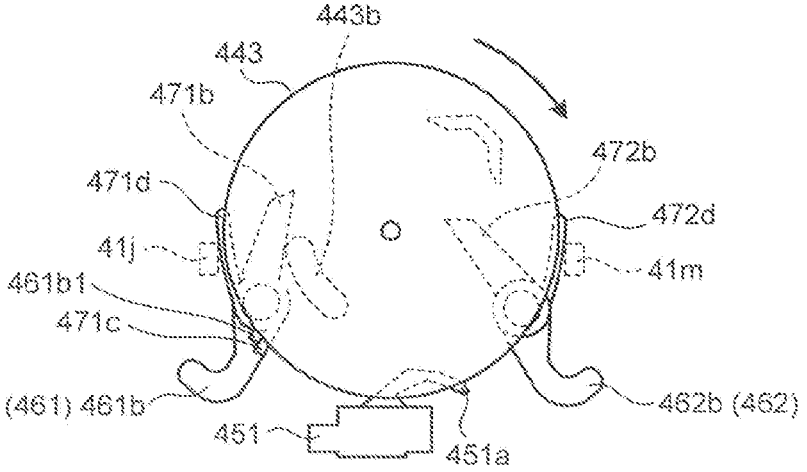

When the motor 43 is driven to rotate reversely in this way, the output gear 443 to which the driving force of the motor 43 is transmitted via the helical gear 441 and the intermediate gear 442 rotates clockwise in a rear view as illustrated in FIGS. 20-1 and 21-1.

When the output gear 443 rotates clockwise in a rear view, the pressing piece 443*c* of the output gear 443 departs from the contactor 451*a* of the carrier switch 451. Accordingly, the contactor 451*a* of the carrier switch 451 is released from the pressed state and is switched to the OFF state.

When the operation piece 443*b* comes in contact with the second contact portion 472*b* of the second arm 472 from the upper side by the rotation of the output gear 443 as illustrated in FIG. 21-2, the second arm 472 rotates about the axis counterclockwise in a rear view. When the second arm 472 rotates counterclockwise, the second operation portion 472*c* presses the protrusion of the second link lever 462 and the second link lever 462 also rotates counterclockwise in a rear view together with the second arm 472. When the second link lever 462 rotates counterclockwise in this way, the tip portion 462*b* moves upward. When the tip portion 462*b* moves upward in this way, as illustrated in FIG. 20-2, the tip portion comes in contact with the claw 37*a* of the pedal link member 37 to cause the pedal link member 37 to move upward against the biasing force of the link spring 37*b* by a predetermined distance (for example, about 15 mm). While the operation piece 443*b* comes in sliding contact with the second contact portion 472*b*, the state in which the pedal link member 37 moves upward by the predetermined distance can be maintained.

With the upward movement of the pedal link member 37, the stopper pin 38*a* moves upward from the lower end of the stopper pin insertion hole 363 and the pedal stopper pin 38*b* moves upward from the lower end of the pedal stopper pin support groove 364.

At this time, since the stopper pin 38*a* moves upward while coming in contact with the stopper contact portion 353 of the upper pedal member 35, the upper pedal member 35 advances from the initial position against the biasing force of the upper pedal member spring as illustrated in FIG. 14. The advancing movement of the upper pedal member 35 is performed along with the upward movement of the stopper pin 38*a*.

As illustrated in FIG. 15, the upper pedal member 35 advancing comes in contact with a second lowest piece of second product (hereinafter, also referred to as next product) to restrain downward movement of the next product.

On the other hand, since the weight of the product coming in contact with the lower pedal member 34 maintained at the forward-moved position is applied to the rotation stopper member 39, the rotation stopper member 39 starts its retreat movement by releasing the restraining of the retreat movement due to the upward movement of the pedal stopper pin 38*b*.

When the rotation stopper member 39 starts the retreat movement in this way, the pedal operating shaft 39*a* departs from the fitting portion 343*a* and the lower pedal member 34 starts its retreat movement against the biasing force of the lower pedal member spring with the weight of the product. The pedal operating shaft 39*a* of the rotation stopper member 39 departing from the fitting portion 343*a* moves to a position at which the first guide portion 343*b* and the second guide portion 343*c* intersect each other along the first guide portion 343*b*.

Thereafter, the lower pedal member 34 retreats with the weight of the lowest product, the downward movement of the lowest product is allowed as illustrated in FIG. 15, and the lowest product is discharged downward. The discharged product is guided to the product discharge port 3*a* via the product chute 5 and can be taken out via the product output port 2*a*.

When the lowest product passes through the lower pedal member 34, the lower pedal member 34 moves to the forward-moved position with the elastic biasing force of the lower pedal member spring and the rotation stopper member 39 also moves to the forward-moved position with the elastic biasing force of the pedal operation member spring. When the lower pedal member 34 and the rotation stopper member 39 move to the forward-moved position, the pedal operating shaft 39*a* held at the position at which the first guide portion 343*b* and the second guide portion 343*c* intersect each other moves to the fitting portion 343*a* along the second guide portion 343*c*, and the lower pedal member 34 and the rotation stopper member 39 are returned to the forward-moved position.

In the meantime, the pedal link member 37 moves upward, the stopper pin 38*a* is located at the upper end of the stopper pin insertion hole 363, and the pedal stopper pin 38*b* is located at the upper end of the pedal stopper pin support groove 364.

Thereafter, when the contact of the operation piece 443*b* with the second contact portion 472*b* is released with the rotation of the output gear 443, as illustrated in FIG. 20-3, the pedal link member 37 is biased to move downward by the link spring 37*b*.

With the downward movement of the pedal link member 37, the stopper pin 38*a* moves downward from the upper end of the stopper pin insertion hole 363, and the pedal stopper pin 38*b* moves downward from the upper end of the pedal stopper pin support groove 364.

When the pedal stopper pin 38*b* moves downward, the pedal stopper pin 38*b* comes in contact with a predetermined portion on the rear surface of the rotation stopper member 39 returned to the forward-moved position. Accordingly, movement in the retreating direction is restrained and the lower pedal member 34 is set to the position to which the lower pedal member moves forward to the second product storage passage 13*b*.

On the other hand, the upper pedal member 35 is biased by the upper pedal member spring and retreats with the downward movement of the stopper pin 38*a*. Accordingly, the downward movement of the next product is allowed, then the next product comes in contact with the forward-moved lower pedal member 34 to restrain the downward movement thereof, and the standby state is started again.

In the drive unit 40, the operation piece 443*b* comes in contact with the first contact portion 471*b* of the first arm 471 with the clockwise rotation of the output gear 443. In this case, since the first locking portion 471*d* comes in contact with the right regulation piece 41*j* formed in the unit base 41, the rotation of the first arm 471 about the axis is restrained. Accordingly, as illustrated in FIG. 21-3, the first contact portion 471*b* is elastically deformed to get close to the first locking portion 471*d*, thereby not interfering with the movement of the operation piece 443*b* due to the rotation of the output gear 443.

Thereafter, when the operation piece 443*b* is returned to the position of the standby state illustrated in FIG. 21-1 with the rotation of the output gear 443, the pressing piece 443*c* presses the contactor 451*a* of the carrier switch 451 to switch the carrier switch 451 to the ON state.

In the above-mentioned reverse rotation driving of the motor 43 in step S109, the discharge control unit 50 monitors whether the carrier switch 451 is switched to the ON state at a predetermined time (steps S110 and S111). That is, the discharge control unit monitors whether the output gear 443 rotates by one turn within a predetermined time.

As a result, when the carrier switch 451 is switched to the ON state within the predetermined time (YES in step S110 and NO in step S111), the discharge control unit 50 stops the reverse rotation driving of the motor 43 (step S112), the process flow is returned, and this process flow is ended. Accordingly, the second product of which the discharge command is issued can be discharged well.

When the carrier switch 451 is not switched to the ON state within the predetermined time, that is, when an ON signal is not output from the carrier switch 451 within the predetermined time (NO in step S110 and YES in step S111), the discharge control unit 50 determines that abnormality occurs (step S113). Then, the discharge control unit 50 notifies the vending machine control unit 100 of the occurrence of abnormality (step S114), the process flow is returned, and this process flow is ended. According to this configuration, it is possible to recognize the occurrence of abnormality in the second product storage passage 13*b* and to stop selling of the second product by lighting a sold-out lamp.

For example, when the product in the first product storage passage 13*a* is sold out, the first sold-out detection lever 61 is biased by the first sold-out detection lever spring 62 and advances into the first product storage passage 13*a*. When the first sold-out detection lever 61 advances in this way, the contact state in which the base end portion 61*a* of the first sold-out detection lever 61 comes in contact with the contact plate 481*b* of the first sold-out link lever 481 is released. When the contact state is released in this way, as illustrated in (b) of FIG. 12, the first sold-out link lever 481 is biased by the first sold-out link lever spring 491 and rotates to the front side about the axis, and the pressing plate 481*c* presses the contactor 452*a* of the first sold-out detection switch 452. Accordingly, the first sold-out detection switch 452 is switched to the ON state and outputs the ON signal to the discharge control unit 50. As a result, information indicating that the product in the first product storage passage 13*a* is sold out is transmitted from the discharge control unit 50 to the vending machine control unit 100 and a user sees the notification by lighting a sold-out lamp not illustrated.

For example, when the product in the second product storage passage 13*b* is sold out, the second sold-out detection lever 71 is biased by the second sold-out detection lever spring 72 and advances into the second product storage passage 13*b*. When the second sold-out detection lever 71 advances in this way, the lever protrusion 73 of the second sold-out detection lever 71 departs from the communication hole 31*d* and the cover hole 42*a*. Accordingly, as illustrated in (b) of FIG. 16, the second sold-out detection lever 71 of which the contact base plate 482*a* comes in contact with the lever protrusion 73 is biased by the second sold-out link lever spring 492 and rotates to the front side about the axis, and the contact base plate 482*a* presses the contactor 453*a* of the second sold-out detection switch 453. Accordingly, the second sold-out detection switch 453 is switched to the ON state and outputs the ON signal to the discharge control unit 50. As a result, information indicating that the product in the second product storage passage 13*b* is sold out is transmitted from the discharge control unit 50 to the vending machine control unit 100 and a user sees the notification by lighting a sold-out lamp not illustrated.

In this way, the motor 43 constitutes a drive source of the first discharge mechanism 20*a* and the second discharge mechanism 20*b*, and the drive unit 40 constitutes the driving force applying unit that alternatively selects the first discharge mechanism 20*a* and the second discharge mechanism 20*b* in accordance with a discharge command and applies the driving force from the drive source to the selected discharge mechanism when the discharge command is issued.

In the above-mentioned product dispensing device 20 according to the embodiment of the present invention, since the first discharge mechanism 20*a* includes the motor 43 serving as a drive source for the first discharge mechanism 20*a* and the second discharge mechanism 20*b* and the drive unit 40 that alternatively selects the first discharge mechanism 20*a* and the second discharge mechanism 20*b* in accordance with a discharge command and applies the driving force from the motor 43 to the selected discharge mechanism when the discharge command is issued, it is possible to decrease the number of drive sources in comparison with the number of discharge mechanisms and to decrease the manufacturing cost. Since the first discharge mechanism 20*a* includes the drive unit 40 including the motor 43, it is also possible to use only the first discharge mechanism 20*a*. That is, some embodiments can be applied to a product storage rack in which an odd number of product storage passages are arranged in the front-rear direction as well as the product storage rack 10 in which an even number of product storage passages 13 are arranged in the front-rear direction. Accordingly, it is possible to achieve a decrease in manufacturing cost and to work flexibly depending on the number of product storage passages 13 adjacent in the front-rear direction.

According to the product dispensing device 20, since the motor 43 as a drive source is a DC motor, the motor is not easily affected by a local voltage or a frequency fluctuation and can be disposed at various locations.

According to the product dispensing device 20, since the first discharge mechanism 20*a* is provided with the first sold-out detection switch 452 and the second sold-out detection switch 453, it is also possible to use only the first discharge mechanism 20*a*. Accordingly, it is possible to work flexibly depending on the number of product storage passages 13 adjacent in the front-rear direction.

In a conventional vending machine, when an AC solenoid is supplied with power, it is not thereafter monitored whether the product discharging device is driven. Accordingly, even when a situation in which a product is not discharged occurs, the vending machine might recognize that the product is sold by supplying power to the AC solenoid. However, according to the product dispensing device 20, when the carrier switch 451 is not switched to the ON state within a predetermined time, abnormality is determined in the discharge control process. Accordingly, by inhibiting selling of the product in the corresponding product storage passage 13, a user having input money or the like can be prevented from being subjected to an unexpected disadvantage.

While the exemplary embodiment of the present invention has been described, the present invention is not limited to the exemplary embodiment and can be modified in various forms.

Figure 22:
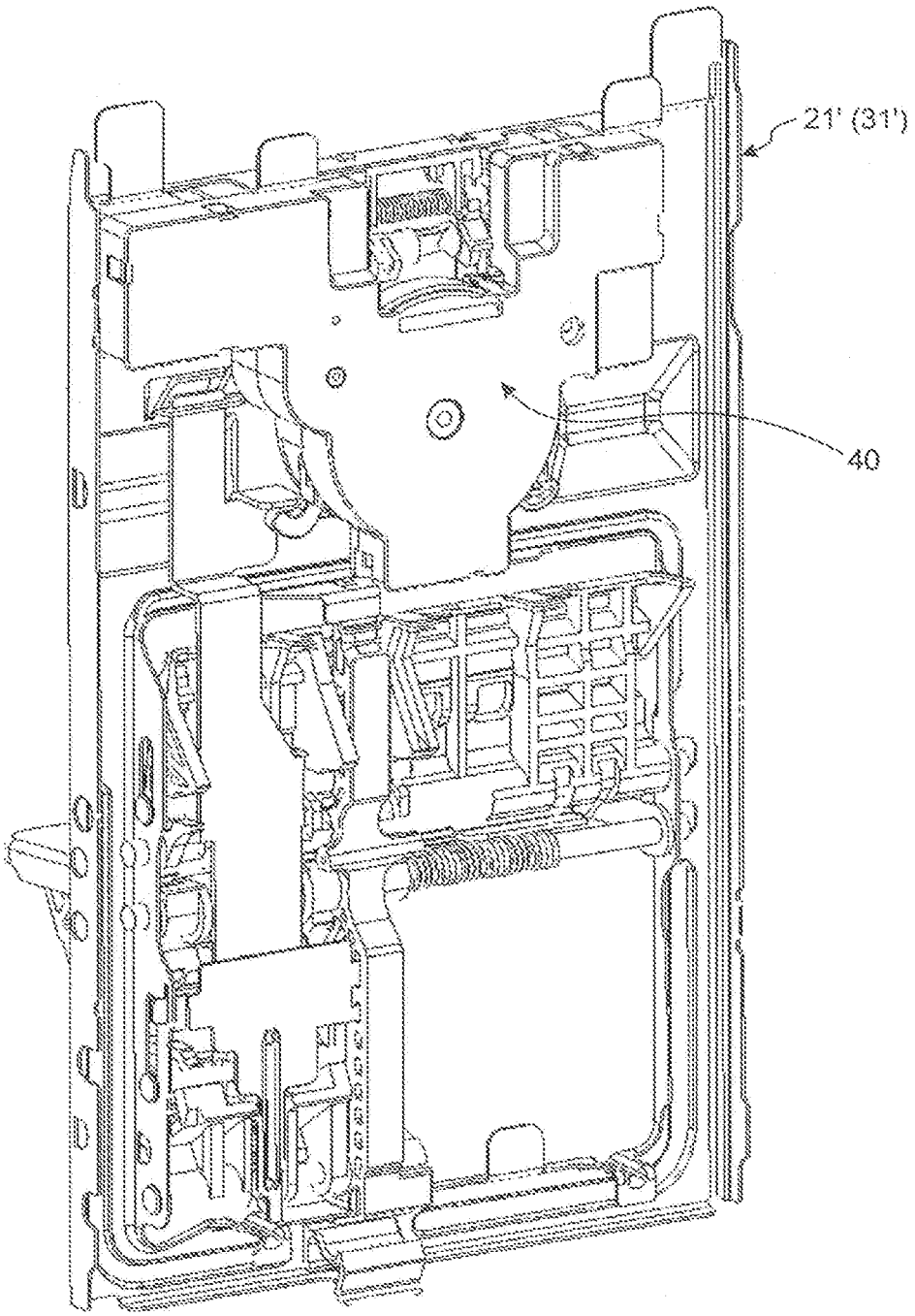
FIG. 22 is a perspective view illustrating a modified example of the embodiment of the present invention.

Although not particularly mentioned in the above-mentioned embodiment, the lateral width of the drive unit 40 in some embodiments is adjusted to such a size to be commonly used to product discharging devices having various lateral widths, that is, product discharging devices having different lateral widths to correspond to product having a relatively-small maximum width and product having a relatively-large maximum width. Accordingly, as illustrated in FIG. 22, some embodiments can be applied to a base member 21' (31') having a lateral width smaller than that of the base member 21 (31) in the above-mentioned embodiment.

In the above-mentioned embodiment, the first discharge mechanism 20*a* corresponds to the first product storage passage 13*a* and the second discharge mechanism 20*b* corresponds to the second product storage passage 13*b*, but the present invention is not limited to this configuration. One product discharging device may correspond to the other product storage passage and the other product discharging device may correspond to one product storage passage.

According to some embodiments, since one product discharging device includes the drive source for the one product discharging device and the other product discharging device and the driving force applying unit that alternatively selects the one product discharging device and the other product discharging device in accordance with the discharge command and applies the driving force from the drive source to the selected product discharging device when the discharge command is issued, it is possible to decrease the number of drive sources in comparison with the number of product discharging devices and thus to decrease the manufacturing cost. Since one product discharging device includes the drive source and the driving force applying unit, it is also possible to use only the one product discharging device. That is, some embodiments can be applied to a product storage device in which an odd number of product storage passages are arranged in the front-rear direction as well as a product storage device in which an even number of product storage passages are arranged in the front-rear direction. Accordingly, it is possible to achieve a decrease in manufacturing cost and flexibly work depending on the number of product storage passages adjacent in the front-rear direction.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A product dispensing device comprising:

one product discharging device that is applied to one product storage passage extending in an up-and-down direction and storing an input product in an extending direction of the one product storage passage, the one product discharging device being configured to restrain the product stored in the one product storage passage from moving downward in a standby state, and to discharge a lowest product stored in the one product storage passage downward in a driven state; and other product discharging device that is applied to other product storage passage extending in the up-and-down direction so as to be adjacent to the one product storage passage and storing an input product in an extending direction of the other product storage passage, the other product discharging device being configured to restrain the product stored in the other product storage passage from moving downward in a standby state, and to discharge a lowest product stored in the other product storage passage downward in a driven state, the one product discharging device and the other product discharging device being coupled to each other back to back, wherein the one product discharging device includes:

a DC motor serving as a drive source; and a driving force applying unit configured to apply a driving force from the DC motor when a discharge command is issued, the driving force applying unit includes:

an output gear configured to rotate about a central axis of the output gear in one direction or in the other direction according to a driving state of the DC motor;

an arm member configured to rotate in accordance with a rotation direction of the output gear when the output gear is rotated; and a link lever member configured such that the one product discharging device and the other product discharging device are alternatively driven in accordance with a rotation of the arm member, the arm member includes:

a first arm configured to rotate about an axis of the first arm when the output gear is rotated in the one direction, and a second arm configured to rotate about an axis of the second arm when the output gear is rotated in the other direction, and the link lever member includes:

a first link lever configured to rotate about an axis common to the axis of the first arm to drive the one product discharging device when the first arm is rotated, and a second link lever configured to rotate about an axis common to the axis of the second arm to drive the other product discharging device when the second arm is rotated.

2. The product dispensing device according to claim 1, wherein the one product discharging device includes a sold-out detection lever configured to: be swingably disposed so as to advance into and retreat from the one product storage passage; be biased by a bias unit to advance into the one product storage passage in a normal state; and retreat from the one product storage passage against a biasing force of the bias unit when the sold-out detection lever comes in contact with a product stored in the one product storage passage, and the other product discharging device includes a sold-out detection lever configured to: be swingably disposed so as to advance into and retreat from the other product storage passage; be biased by a bias unit to advance into the other product storage passage in a normal state; and retreat from the other product storage passage against a biasing force of the bias unit when the sold-out detection lever comes in contact with a product stored in the other product storage passage.

3. The product dispensing device according to claim 2, wherein the one product discharging device includes:

a sold-out detection switch configured to be switched to an OFF state when the sold-out detection lever retreats from the one product storage passage and to be switched to an ON state when the sold-out detection lever advances into the one product storage passage so as to detect that the one product storage passage is in a sold-out state; and a sold-out detection switch configured to be switched to an OFF state when the sold-out detection lever disposed in the other product discharging device retreats from the other product storage passage and to be switched to an ON state when the sold-out detection lever disposed in the other product discharging device advances into the other product storage passage so as to detect that the other product storage passage is in a sold-out state.

4. The product dispensing device according to claim 1, wherein the DC motor serves as a drive source for the one product discharging device and the other product discharging device and is configured to drive to rotate positively and reversely, the output gear rotates about the central axis in the one direction when the DC motor is driven to rotate positively, the output gear rotates about the central axis in the other direction when the DC motor is driven to rotate reversely, the first arm rotates by an operation piece coming in contact with a first contact portion of the first arm, the operation piece being provided in the output gear, when the output gear is rotated in the other direction, the first arm deforms elastically in a state where a rotation of the first arm is restrained even if the operation piece comes in contact with the first contact portion, thereby allowing a rotation of the output gear, the second arm rotates by the operation piece coming in contact with a second contact portion of the second arm, when the output gear is rotated in the one direction, the second arm deforms elastically in a state where a rotation of the second arm is restrained even if the operation piece comes in contact with the second contact portion, thereby allowing the rotation of the output gear;

the one product discharging device corresponds to the first link lever, and the other product discharging device corresponds to the second link lever.

5. The product dispensing device according to claim 4, wherein the output gear rotates about the central axis extending in a front-rear direction, and the operation piece is provided on a front surface of the output gear, each of the first arm and the second arm rotates an axis extending in a front-rear direction and is provided on the front side of the output gear.

6. The product dispensing device according to claim 4, wherein the first link lever is configured such that a pedal link member included in the one product discharging device moves to drive the one product discharging device when the first link lever is rotated, the second link lever is configured such that a pedal link member included in the other product discharging device moves to drive the other product discharging device when the second link lever is rotated.

* * * * *